United States Patent [19]

Shimizu et al.

[11] Patent Number: 4,937,621

[45] Date of Patent: Jun. 26, 1990

[54] MALFUNCTION DISPLAY AND OPERATION INHIBITING DEVICE FOR AN IMAGE FORMING APPARATUS

[75] Inventors: Katsuichi Shimizu, Hoya; Toshio Honma, Tokyo; Hisashi Sakamaki, Yokohama, all of Japan

[73] Assignee: Canon Kabushiki Kaisha, Tokyo, Japan

[21] Appl. No.: 157,144

[22] Filed: Feb. 10, 1988

Related U.S. Application Data

[60] Continuation of Ser. No. 802,596, Nov. 27, 1985, abandoned, which is a division of Ser. No. 518,094, Jul. 28, 1983, abandoned, which is a division of Ser. No. 75,968, Sep. 17, 1979, Pat. No. 4,470,692, which is a continuation of Ser. No. 744,427, Nov. 23, 1976, abandoned.

[30] Foreign Application Priority Data

| | | | |
|---|---|---|---|
| Nov. 28, 1975 | [JP] | Japan | 60-143178 |
| Nov. 28, 1975 | [JP] | Japan | 60-143179 |
| Nov. 28, 1975 | [JP] | Japan | 60-143180 |
| Dec. 2, 1975 | [JP] | Japan | 60-144158 |

[51] Int. Cl.[5] ..... G03G 21/00

[52] U.S. Cl. ..... 355/206

[58] Field of Search ..... 355/14 R, 14 SH, 14 C, 355/14 CU, 203, 205, 206, 204

[56] References Cited

U.S. PATENT DOCUMENTS

| | | | |
|---|---|---|---|
| 3,558,472 | 6/1971 | Glaster et al. | 235/92 |
| 3,909,128 | 9/1975 | Sohm | 355/14 X R |
| 4,035,072 | 7/1977 | Deetz et al. | 355/14 |

*Primary Examiner*—Fred L. Braun

*Attorney, Agent, or Firm*—Fitzpatrick, Cella, Harper & Scinto

[57] ABSTRACT

An image forming apparatus having a device for setting numerical data related to image formation; a memory device for storing the numerical data set by the setting device; a device for executing the image formation in accordance with the numerical data stored in the memory device; a device for cancelling the numerical data stored in the memory device; and a device for inhibiting numerical data from being set by the setting device during an improper operational state of the apparatus.

25 Claims, 31 Drawing Sheets

| FIG. 1A | FIG. 1B |
|---|---|

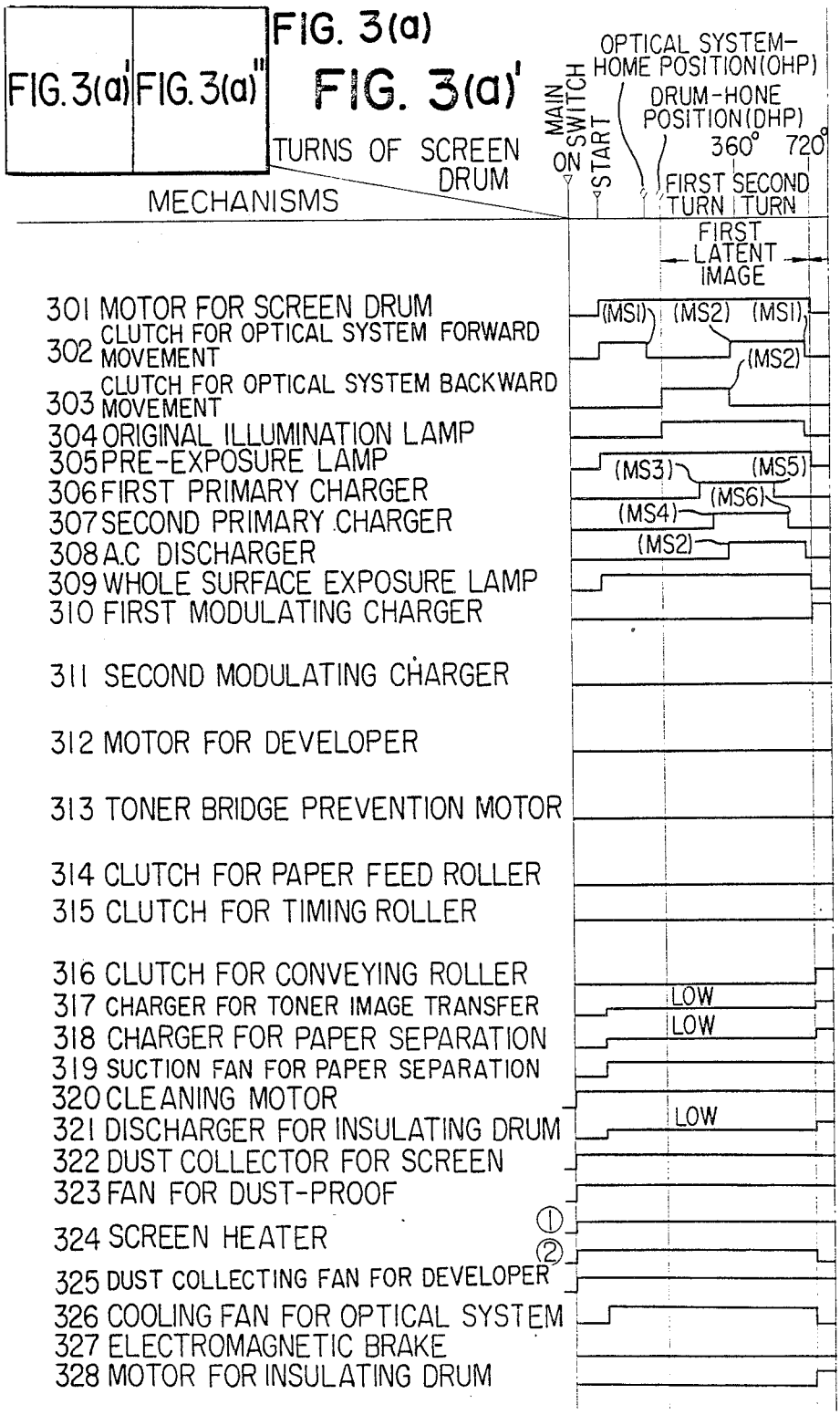
FIG. 3(a)'
FIG. 3(a)''
FIG. 3(a)
TURNS OF SCREEN DRUM
MECHANISMS
MAIN SWITCH ON
START
OPTICAL SYSTEM-HOME POSITION(OHP)
DRUM-HONE POSITION(DHP)
360°
720°
FIRST TURN
SECOND TURN
FIRST LATENT IMAGE
301 MOTOR FOR SCREEN DRUM
302 CLUTCH FOR OPTICAL SYSTEM FORWARD MOVEMENT
303 CLUTCH FOR OPTICAL SYSTEM BACKWARD MOVEMENT
304 ORIGINAL ILLUMINATION LAMP
305 PRE-EXPOSURE LAMP
306 FIRST PRIMARY CHARGER
307 SECOND PRIMARY CHARGER
308 A.C DISCHARGER
309 WHOLE SURFACE EXPOSURE LAMP
310 FIRST MODULATING CHARGER
311 SECOND MODULATING CHARGER
312 MOTOR FOR DEVELOPER
313 TONER BRIDGE PREVENTION MOTOR
314 CLUTCH FOR PAPER FEED ROLLER
315 CLUTCH FOR TIMING ROLLER
316 CLUTCH FOR CONVEYING ROLLER
317 CHARGER FOR TONER IMAGE TRANSFER
318 CHARGER FOR PAPER SEPARATION
319 SUCTION FAN FOR PAPER SEPARATION
320 CLEANING MOTOR
321 DISCHARGER FOR INSULATING DRUM
322 DUST COLLECTOR FOR SCREEN
323 FAN FOR DUST-PROOF
324 SCREEN HEATER
325 DUST COLLECTING FAN FOR DEVELOPER
326 COOLING FAN FOR OPTICAL SYSTEM
327 ELECTROMAGNETIC BRAKE
328 MOTOR FOR INSULATING DRUM
(MS1)
(MS2)
(MS1)
(MS2)
(MS3)
(MS5)
(MS6)
(MS4)
(MS2)
LOW
LOW
LOW
①
②

FIG. 3(a)"
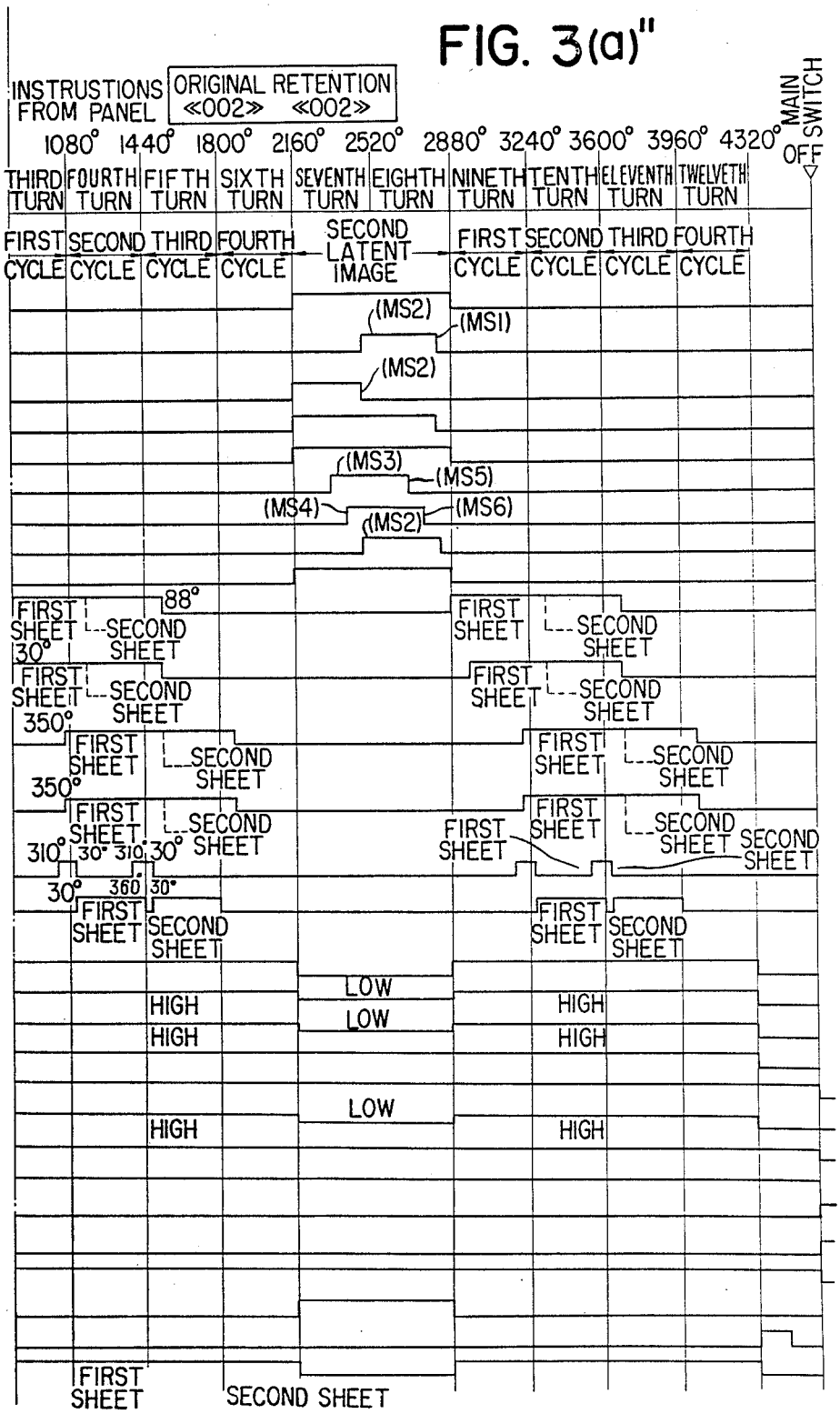

CONTROL BLOCK DIAGRAM

| FIG. 9(A) | FIG. 9(B) |
|---|---|

| FIG. 10(a)' |
| --- |
| FIG. 10(a)'' |

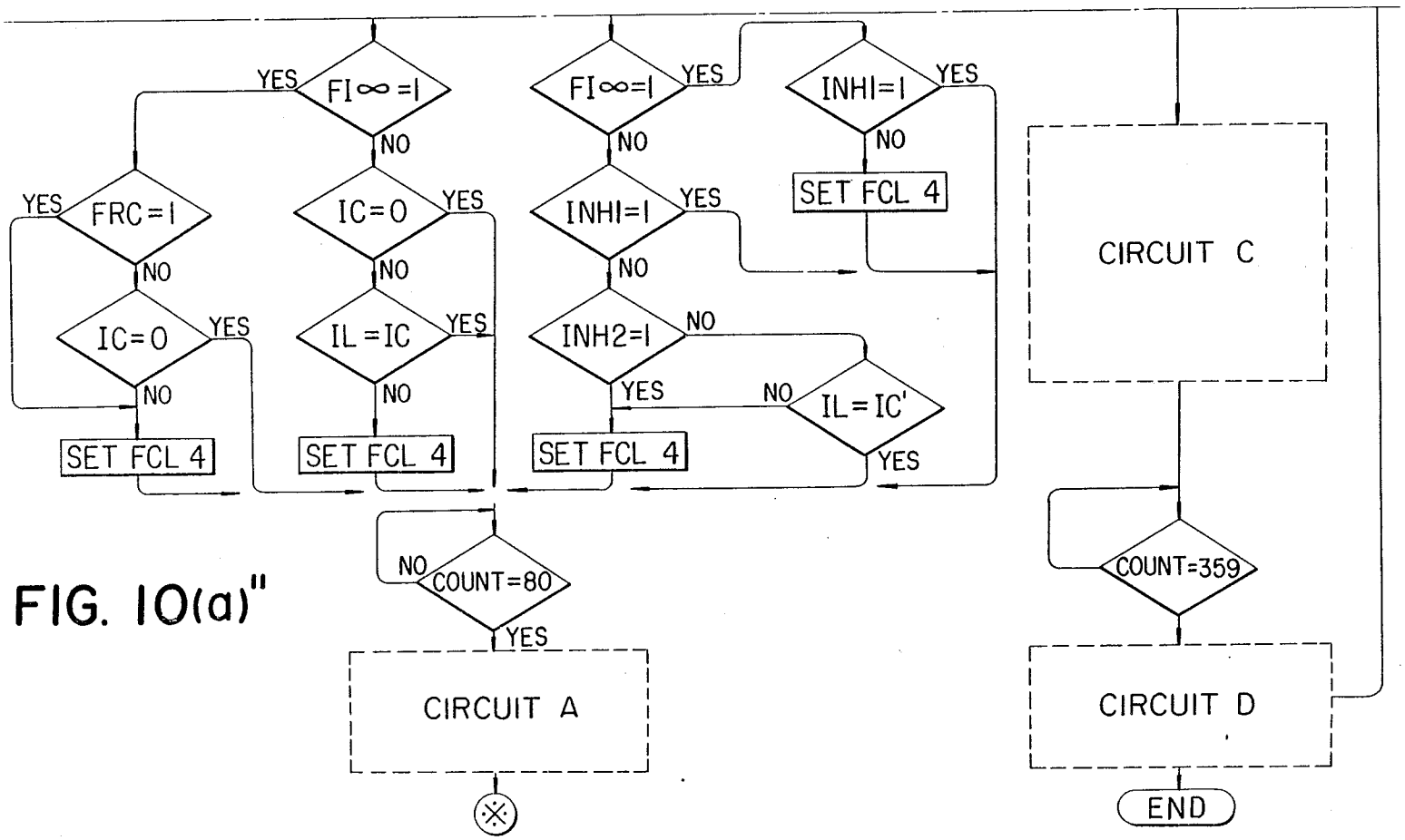
FIG. 10(a)"

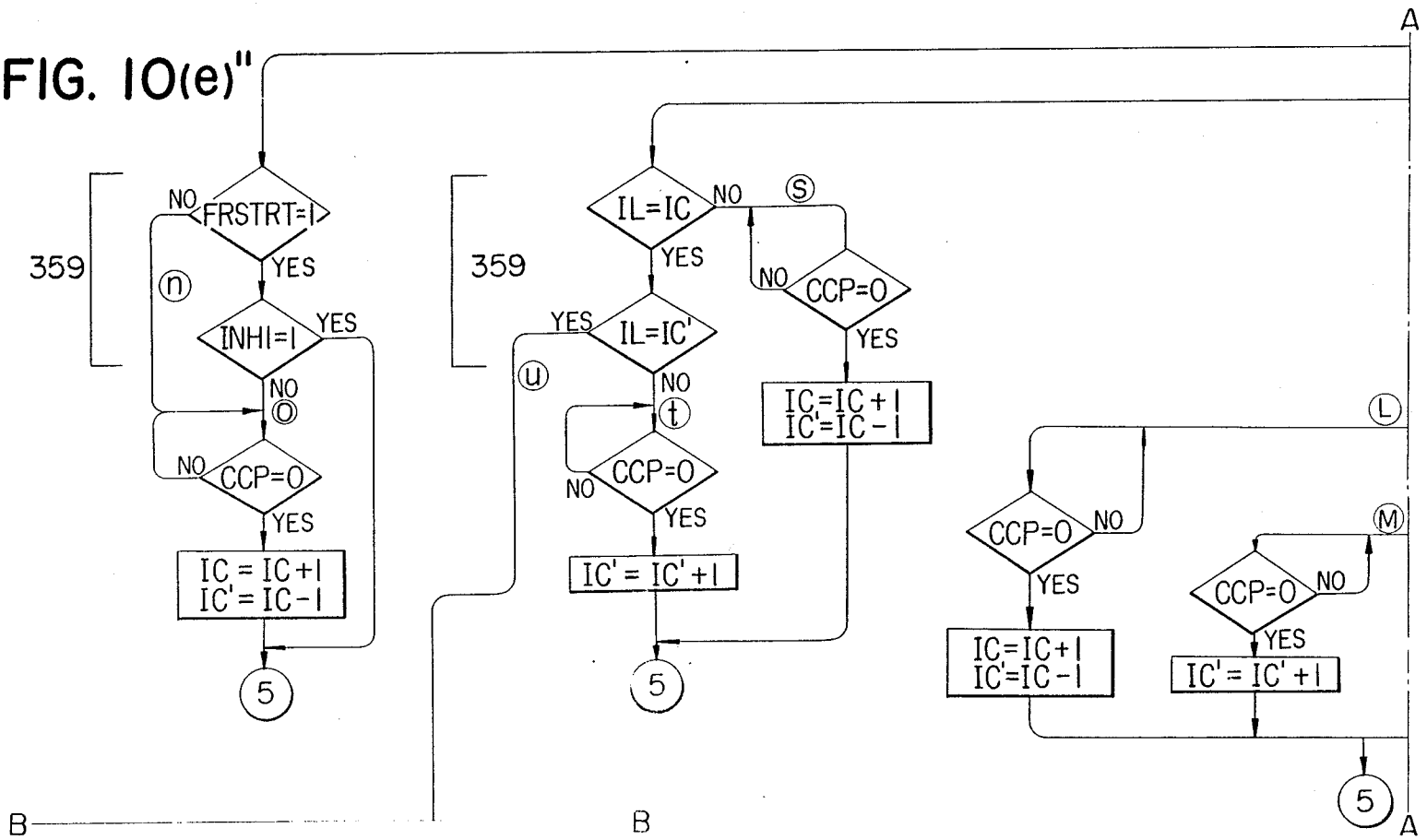
FIG. 10(e)"

MALFUNCTION DISPLAY AND OPERATION INHIBITING DEVICE FOR AN IMAGE FORMING APPARATUS

This application is a continuation of application Ser. No. 802,596, filed on Nov. 27, 1985, now abandoned, which in turn is a division of Ser. No. 518,094, filed on Jul. 28, 1983, now abandoned, which in turn is a division of Ser. No. 075,968, filed Sept. 17, 1979, now U.S. Pat. No. 4,470,692, which in turn is a continuation of Ser. No. 744,427, filed Nov. 23, 1976, and now abandoned.

BACKGROUND OF THE INVENTION a. Field of the Invention

This invention relates to a printing or copying apparatus having a control system which is effective to the processing required for printing or copying.

b. Description of the Prior Art

In a copying apparatus having, for example, a drum-shaped image formation member, continuous copying could heretofore be accomplished by rotating the drum and at the same time, using drum signals to continuously repeat the processes such as formation of a latent image on the image formation member, development of the latent image and transfer of the developed image. Therefore, in continuous copying, it has been required that the devices necessary for an earlier process be already started to operate before a subsequent process is begun. However, the presence of a device such as paper feed roller which is to be started later has made it unavoidable to secure some interval between a process and a subsequent process and accordingly, the formation of a first latent image could not immediately be followed by the start of the formation of a second latent image. This has led to limitations in increasing the copying speed and in addition, a disadvantage that the shape of the drum cannot efficiently be determined.

Further, many of the conventional copying machines have been such that when a number of copies are to be produced from the same image original, the original is illuminated and scanned to form an electrostatic latent image on a photosensitive medium each time, but this has made it mechanically difficult to reduce the time required for the optical scanning system to return to its original position after the illumination and scanning and therefore, enhancement of the copying speed has been limited. Furthermore, continuous production of multiple copies has required the photosensitive medium to be repetitively used and this has led to great fatigue or wear and accordingly, shorter life, of the photosensitive medium.

Heretofore, setting and counting of the number of copies to be produced and display of the set value or the counted value have been done by a selector using a ratchet-gear combination or by a mechanical selector using rotary switches or thumb wheel switches for respective display digits.

However, the purely mechanical selector is not suited for high-speed copying and the selector using rotary switches or the like has been liable to cause malfunctioning resulting from unsatisfactory engagement between the mechanical contacts thereof and moreover, where a number of digit places are to be set, a correspondingly great number of rotary switches have been required and this has led to great cumbersomeness involved in the setting of the number of copies.

Also, in the conventional copying machines, paper jam occurring within the machine has been indicated by a lamp or the like provided on the panel of the machine and such display has been done independently of other displays (display of the number of copies and the like). Thus, on the panel, various display devices must be discretely provided such as the display device for displaying the number of copies, the display device exclusively for display of jam and other display devices and this involves great complication of the panel structure and the necessity of correspondingly numerous mechanisms and circuits for driving the individual display devices. With the present-day tendency of copying machines toward diversification in view, this will further add to complication of the mechanisms and circuits in copying machines. Therefore, if it is desired to display as various states as possible of the machine, the operator or serviceman will have to acquire advanced technical skill regarding the display devices. If, on the other hand, it is desired to reduce the number of display devices the repair or check of a failure in the machine will become difficult.

Also, when paper happens to jam in its path of conveyance, it is usually the case with the operator that he temporally stops the machine for the purpose of removing the jam. In such a case, if the machine is a copying machine, the number of copies to be produced must be reset, otherwise the number of copies as desired could not be obtained even if copying operation was resumed after the removal of the jam.

SUMMARY OF THE INVENTION

It is an object of the present invention to provide a printing or copying apparatus having a control system which eliminates the above-noted disadvantages.

It is another object of the present invention to provide a printing or copying apparatus having a control system which integratedly effects the printing or copying process comprising numerous steps.

It is still another object of the present invention to provide a printing or copying apparatus having a control system which controls the operations of processing means for forming a latent image of an image original on a photosensitive or an insulating medium, for developing the latent image and for transferring the developed image, by the use of signals synchronous with the movement of the photosensitive or the insulating medium, signals resulting from the repetition of the process and signal corresponding to the set number of prints.

It is yet still another object of the present invention to provide a printing or copying apparatus having a control system which is convenient for the purpose of producing a number of copies at a high speed by repetitively forming a secondary latent image on the insulating medium from a primary latent image on the photosensitive medium.

It is a further object of the present invention to provide a copying or printing apparatus in which the process of forming a secondary latent image on the insulating drum from a primary latent image of an image original formed on a photosensitive screen drum, the process of developing the secondary latent image and the process of transferring the developed image are controlled with one complete rotation of the screen drum as the reference.

It is a further object of the present invention to provide a copying or printing apparatus in which the corona discharge voltage used for the formation of said secondary latent image is controlled in accordance with the set number of prints.

The present invention employs numeric key switches to set the number of copies and solves the various problems resulting from the use of such key switches in a copying machine.

When the number of digit places of the numberical display device is minimized to a necessary number with the normal maximum number of copies taken into consideration, the present invention provides a key and the like for enabling a greater number of copies to be produced as infinite copy (multi-copy) and also enables the display thereof to appear as a symbol distinctly from key inputs.

It is also an object of the present invention to divert a particular display device (for example, that for displaying the number of copies) to the display of various states of the copying machine, such as not only display of jam but also display of the point where the jam occurred, the point of failure in the machine, or display of from-time-to-time change in the number of copies during the copying operation.

The present invention also provides a unique system whereby, even if jam occurs, the process control may be maintained to enable a predetermined number of copies to be automatically produced after the jam is released.

The invention will become more fully apparent from the following detailed description thereof taken in conjunction with the accompanying drawings.

DESCRIPTION OF THE PREFERRED EMBODIMENTS

The present invention will hereinafter be described with respect, for example, to an apparatus using, as a photosensitive medium, a photosensitive screen of three-layer construction comprising an insulating layer, a photoconductive layer and an electrically conductive layer to produce copies with high contrast at higher speed (see Published Japanese Patent Application 19455/1975), wherein the photosensitive medium is subjected to first charging, exposure to light from image original and discharging simultaneous with or subsequent to said exposure to thereby form a primary latent image on the photosensitive medium, whereafter corona ion flow is modulated by the primary latent image to form a secondary latent image on an insulative member adjacent to the photosensitive medium and the secondary latent image is developed into a visible image by well-known developing means while the insulative member is moved, and then the visible image is transferred onto a sheet of plain paper, which is in turn separated from the insulative member to provide a copy.

Figure 1A:
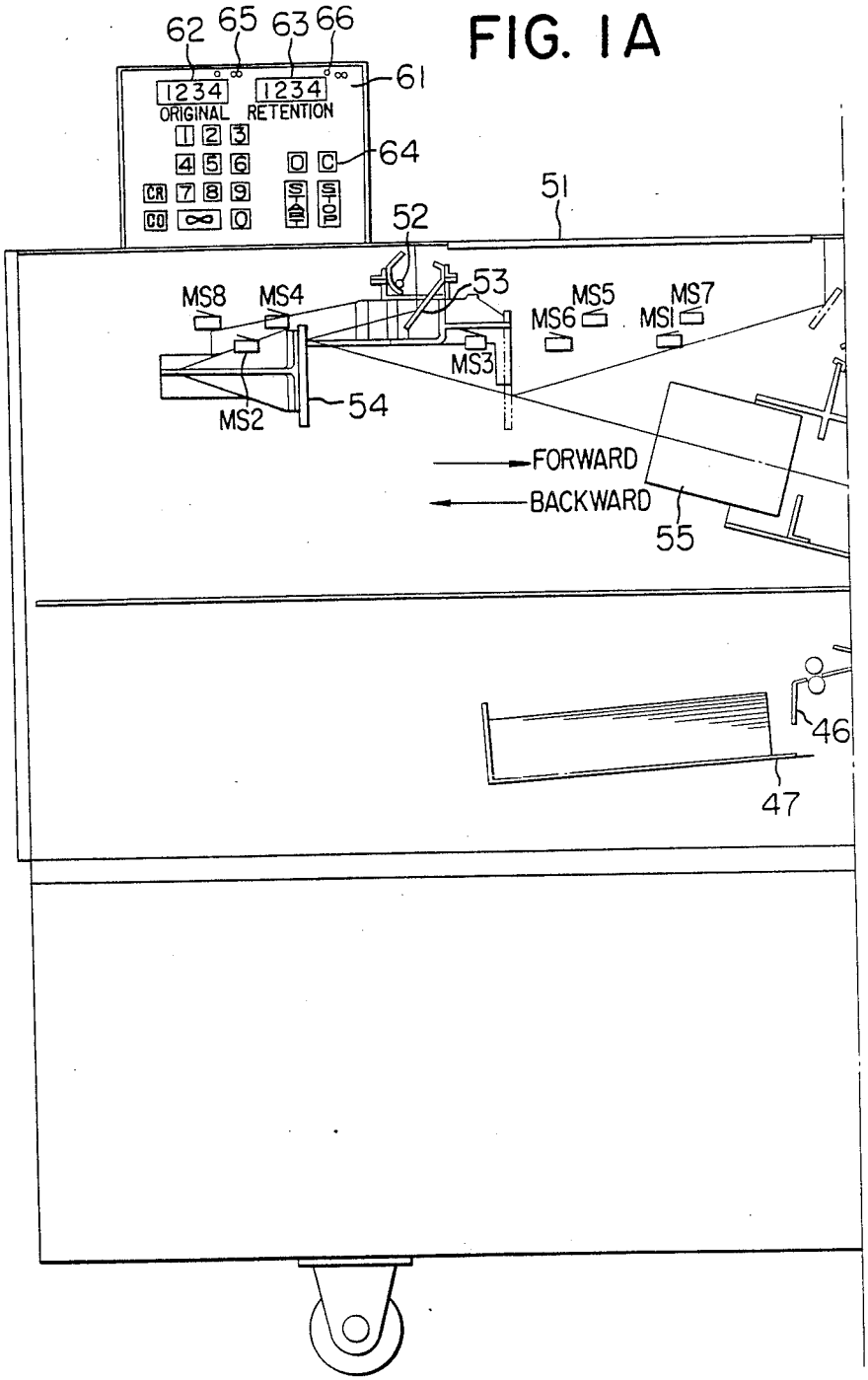
FIGS. 1, 1A, and 1B combined form a schematic cross-sectional view of an example of the copying apparatus according to the present invention.
Figures 1, 1B:
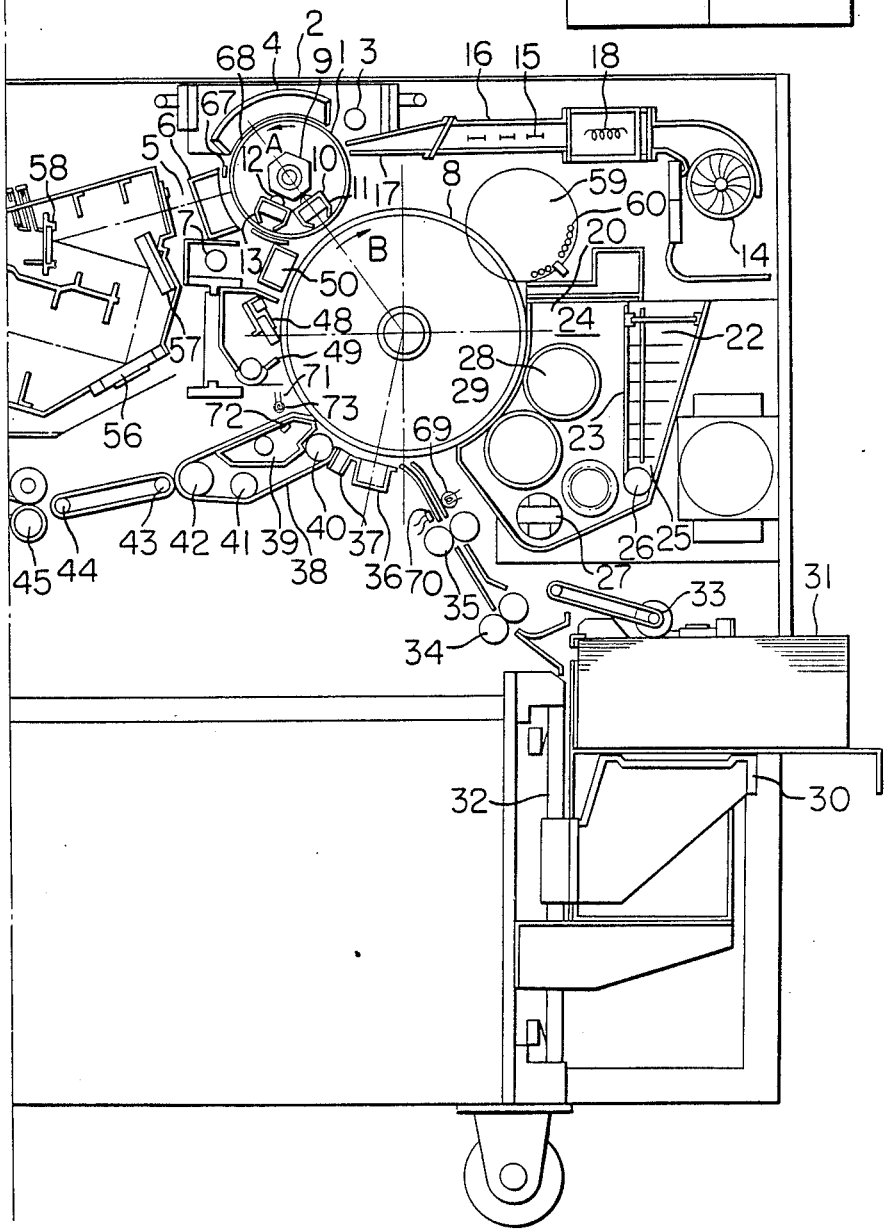
Figure 17:
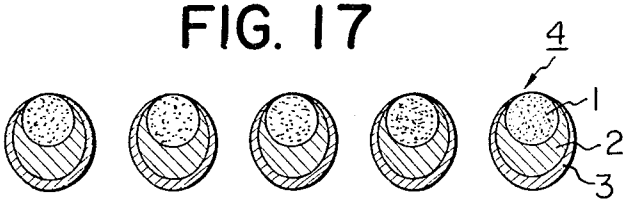
FIG. 17 is a cross-sectional view of a photosensitive screen.

FIG. 1 is a cross-sectional view of such a copying apparatus, the mechanical construction of which will now be described. The aforementioned three-layer photosensitive screen (see FIG. 17) is extended over and adhesively or otherwise secured to a metallic screen drum substrate having annular opposite ends integrally connected together by a connecting band, thus forming a screen drum 1, and this screen drum is mounted on a tubular screen drum shaft 2. With the application of a bias voltage taken into account, a screen drum flange of insulating material is secured to each end of the screen drum 1 as by screws, and the forward portion of the screen drum flange has an opening through which a modulating charger 11 (second modulating charger) and a pre-modulating charger (first modulating charger) 13 may be mounted within the screen drum 1. The screen drum flange is installed on the tubular screen drum shaft 2 which is fixed by means of ball bearings. The screen drum 1 is rotatable about the fixed screen drum shaft 2.

The screen drum 1 is formed by an electrically conductive member 70 having a number of fine apertures and a photoconductive member 71 and an insulating member 72 successively layered over the conductive member 70 so that one surface of the conductive layer is exposed. The conductive member may be prepared by knitting thin wire of metal such as stainless metal or nickel into the form of netting. The mesh value of the conductive member may suitably be 100 to 400 meshes in terms of the resolving power for copying, and may preferably secure a numerical aperture of 50% or more. The photoconductive member may be prepared by evaporating Se-alloy or the like, or by spray-coating of dispersed insulative resin carrying particles of CdS, PdO or like substance, or by etching. The insulating member may be prepared by either spraying or vacuum-evaporating a solvent type organic insulative material such as epoxyresin, acrylic resin or silicone resin. Exposing one surface of the conductive member may be accomplished by applying the coating or the spray to the conductive member with one surface thereof covered by suitable means, or by grinding the portion of the coating material which has come round to cover said one surface of the conductive member.

The following devices necessary for the formation of electrostatic latent image on the photosensitive screen are disposed around the screen drum 1. A pre-exposure lamp 3 is provided to erase undersirable ghost or the like on the photosenitive screen, and a primary charger 4 serves to impart uniform electrostatic charge onto the photosensitive screen. Since the diameter of the screen drum is relatively small, the leading end portion of the formed image may sometimes be recharged during the formation of electrostatic latent image on the photosensitive screen, in spite of an electrostatic latent image having already been formed thereon. Therefore, the primary charger 4 is divider into two, and the same voltage or the same current may be applied to the two chargers at a time interval. An AC discharger 6 is provided to remove the charge from the photosensitive medium in accordance with the light image 5 of the original illuminated by an original illumination lamp 52. The AC discharger may be replaced by a DC discharger opposite in polarity to the primary charger. A whole surface exposure lamp 7 is used to enhance the contrast of the primary latent image formed on the photosensitive screen. An insulating drum 8 comprising an electrically conductive member coated with an insulating layer in the form of thin film is juxtaposed closely adjacent to the screen drum 1. The screen drum 1 and the insulating drum 8 are rotatable in synchronism with each other but in the directions of arrows A and B, respectively.

Within the screen drum 1, a modulating charger 11 is mounted on a rail 10 supported by an insulating block 9 at the nearest position with respect to the insulating drum 8 and a pre-modulating charger 13 is mounted on a rail 12 also supported by the insulating block 9. In order to prevent dust from sticking to the screen drum 1 to hinder the formation of primary and secondary latent images, a blower 14 and a discharger 15 within the duct of the blower are provided to cause any suspending dust to stick to the back plate of the discharger and to cause clean air to be blown against the screen drum through a dust-removing nozzle 17. When the photosensitive screen is adversely affected by low terperature and high humidity, the air being blown may also by heated by a heat source 18. The pre-modulating charger 13 serves to apply a voltage opposite in polarity to that of the modulating charger 11 so as to ensure the potential of primary latent image on the screen drum 1 to be constant at all times when a number of secondary latent images are to be obtained from that primary latent image.

The secondary latent image on the insulating drum 8 may be developed by a developing device 20. The developing device 20 includes toner supply means 22 which is separated from a developing section 24 by a partition plate 23. Developing toner 25 may be supplied into the developing device 20 by rotation of a toner distribution roller 26. The developing toner 25 may be sufficiently agitated by rotation of an agitating roller 27 to develop the electrostatic latent image on the insulating drum 8 with the aid of a sleeve 29 containing magnet 28 therewithin.

A paper feed table 30 is capable of carrying thereon a great quantity of copy paper (2,000 to 4,000 sheets), and the uppermost level of the copy paper stock may be detected so that the uppermost level 31 may always assume a predetermined position and the paper feed table may be lifted along a guide rail 32 by the drive of a lift motor in accordance with the decrease in quantity of the copy paper.

A sheet of copy paper may be fed from the uppermost level of the copy paper stock by a pick-up roller 33 substantially in synchronism with the visible image on the insulating drum 8 and further made coincident with that visible image by timing rollers 34, and then passed between conveying rollers 35 so that the visible image on the insulating drum 8 may be transferred to the copy paper by an image transfer charger 36. A separating charger 37 is provided to weaken the attraction between the insulating drum 8 and the copy paper, and a conveyor belt 39 containing a suction device 39 therewithin is provided to separate the copy paper from the insulating drum 8 and convey the same. The conveyor belt 39 is extended over a belt driving roller 40 and rollers 41,42 and movable round with the rotation of these rollers to convey the copy paper while attracting it thereto. A further conveyor belt is extended over rollers 43 and 45 to convey the copy paper to a set of fixing rollers 45. Then, the toner image on the copy paper may be fused and fixed, whereafter the copy paper may be passed along a guide 46 and onto a tray 47.

Operation of the Key Operating Board

The running of the copy apparatus of the present invention is started by an order from a operating board 61 shown in FIG. 1. The operation board 61 comprises two display devices 62,63, two pilot lamps 65,66 and a keyboard 64. A key "O" (ORIGINAL) on the keyboard 64 is used to set the number of electrostatic latent images to be formed on the screen drum 1. If numeric keys "0" to "9" are depressed in subsequence to the depression of the "0" key, the contents of these keys may be successively entered into the display device 62. If a key "∞" is depressed after the entry of the numeric keys, the contents of the display device 62 will be cleared to turn on the "∞" pilot lamp 65. If, conversely, the numeric keys are depressed after the "∞" pilot lamp is turned on, this pilot lamp will be turned off and the figures will be entered into the display device 62. Thus, the numeric data and the "∞" order may be automatically changed over. It is to be noted here that "∞" means an operation to be infinitely continued until there comes a "STOP" order which will later be described.

A key "R" (RETENTION) is used to set the number of copies to be produced from a single electrostatic latent image formed on the screen drum. Entry of the numeric keys or the "∞" key may be done in the same manner as described above in connection with the "0" key, and the contents of these keys may be displayed by the display device 63 or the pilot lamp 66. For example, when <<123>> and <<456>> are to be entered into the display devices 62 and 63, respectively, the key depressions may take place in the sequence of "0"→"1"→"2"→"3"→"R"→"4"→"5"→"6". Thus, the "0 " to "9" numeric keys and the "∞" key may be arbitrarily entered into the two display devices 62,63 or the two pilot lamps 65,66 by changing over the two function keys "O" and "R". Of course, the depressions of the "O" key and the "R" key may be interchanged in order. A key "CO" (CLEAR ORIGINAL) serves to clear the display device 62 or the pilot lamp 65, and may be used to correct any numeric data erroneously entered. For example, when <<123>> entered into the display device 62 is to be corrected to <<456>>, keys may be depressed in the sequence of "CO"→"0"→"4"→"5"→"6". A key "CR" (CLEAR RETENTION) is provided to serve a similar purpose and may be used to clear the display device 63 or the pilot lamp 66.

A "START" key is used to start the copying operation, but this key will not work when the contents of the display devices 62,63 and the pilot lamps 65,66 are in an irrational combination. Such an irrational combination refers to the case where the contents of the display device 62 is <<007>> and the case where both of the pilot lamps 65 and 66 are turned on. The former case is irrational because no copying can place without an electrostatic latent image being why formed on the screen drum 1, and why the latter case is irrational because an infinite number of retentions can not take place every time an electrostatic latent image is formed on the screen drum 1. Also, once the "START" key is operated to start the copying apparatus, the keys other than the "STOP" key are prohibited from operating by a prohibition circuit which will later be described. Further, when <<002>> and <<003>> are entered into the display devices 62 and 63, respectively, a primary latent image will be formed on the screen drum, and then modulation, development and transfer will take place three times each, whereafter this cycle will be repeated once again, whereby six copies will be produced. In this case, the two display devices will display <<000>> upon operation of the "START" key and will come to display <<001>>, <<002>> and so on as the copying operation progresses.

Operating Board Circuit

Figures 2, 2A:
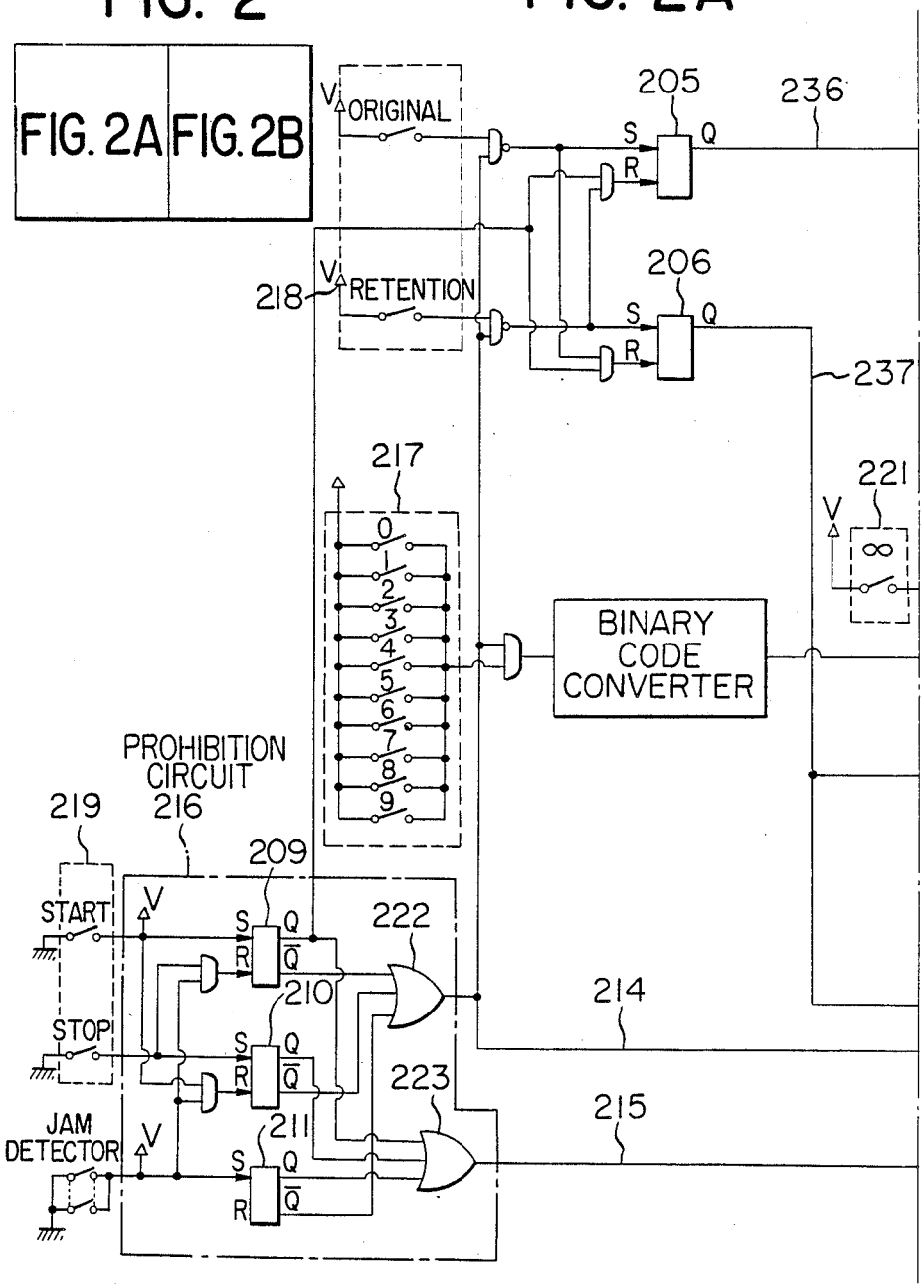
FIGS. 2, 2A, and 2B diagrammatically shows the driving circuit for the display device in an example of the copying apparatus according to the present invention.
Figure 2B:
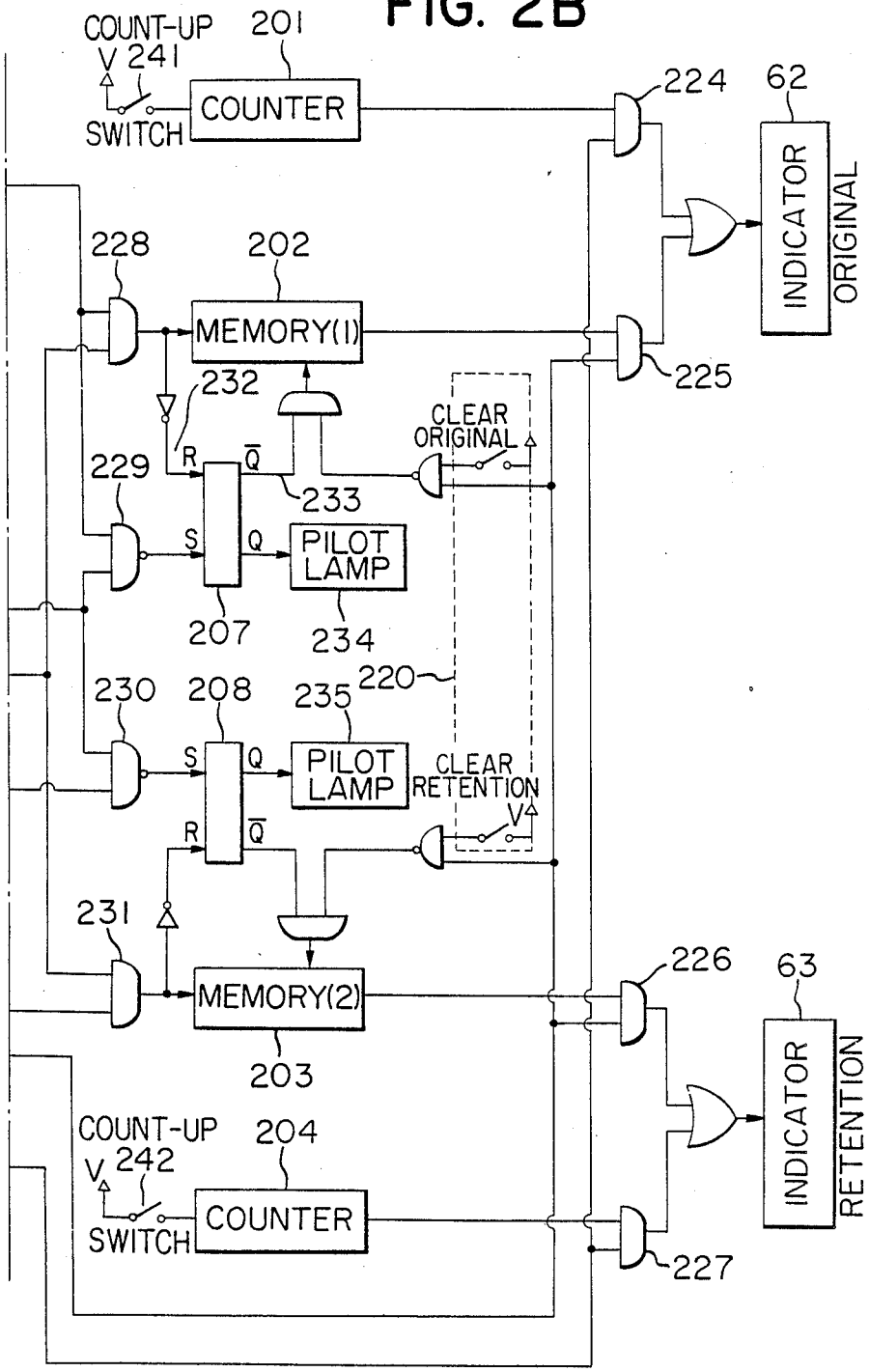

FIG. 2 is a block diagram of the operating board circuit in the present invention. A memory 202 and a counter 201 correspond to the display device 62 and respectively serve to store and count the number of times an electrostatic latent image is formed on the screen drum. A memory 203 and a counter 204 correspond to the display device 63 and respectively serve to store and count the number of copies produced from a single primary latent image. These counters 201 and 204 may be diverted from a screen drum counter and and insulating drum counter which will later be described.

Operation of the circuit will now be described. Signals from a group of keys 217–221 on the operating board are gated by the output signal 214 from a prohibition circuit 216, and this signal line 214 is normally at the "1" level, but whenever the prohibition circuit 216 is operated, the signal line 214 assumes the "0" level so that no output is produced even if the key group is operated. The prohibition circuit 216 comprises flip-flops 209, 210, 211 and two OR gates 222, 223. The flip-flops respectively store the depression of the "START" key, the depression of the "STOP" key, and the jam of paper such as excess of paper, feeding of two sheets at a time, unsatisfactory separation of paper or the like. The flip-flops 209 and 210 are such that they are not set at a time but one of them is set while the other is reset. That is, the "START" order and the "STOP" order never work at a time. Also, whenever the flip-flop 211 is set, the flip-flops 209 and 210 are reset by all means and interrupt every operation when paper jam happens. The outputs of the OR gates 222 and 223 are normally at the "1" and the "0" level, respectively, but these are reversed to the "0" and the "1" level when any one of the flip-flops 209, 210 and 211 is set. That is, when one of the "START" key, the "STOP" key and the jam detector is being operated, the signal line 214 assumes the "0" level and the sigal line 215 assumes the "1" level. Thus, the group of keys 217, 218, 220 and 221 on the operating board are prohibited while, at the same time, the gates 225 and 226 are closed and the gates 224 and 227 are opened so that, in the display devices 62 and 63, the contents of the memories 202 and 203 are replaced by the contents of the counters 201 and 204, which are thus displayed. During the copying operation, the keys other than the "STOP" key are inoperable. Therefore, at the moment the "START" key is actuated, the contents of the counters are still zero and thus, the display device 62 changes from <<002>> to <<000>> while the display device 63 changes from <<003>> to <<000>>. However, as the copying operation progresses, these figures are counted up until the figures of the corresponding memories and the figures of the corresponding counters become equal, whereupon the copying operation is terminated. Upon termination of the copying operation, each of the counters is cleared to zero in preparation for another cycle of operation and the display devices 62 and 63 again display the figures of the memories.

The "STOP" key, when depressed at any desired point of time during the copying operation, may bring the copying operation to an end at an operationally good point apart from said point of time.

Flip-flops 205 and 206 store the depressions of the "O" " and the "R" key, respectively, and they are such that they are not set at a time but one of them is set while the other is always reset. When the "O" key is depressed, the flip-flop 205 is set while the gates 228 and 229 are opened. Subsequently, when one of the numeric keys 217 is depressed, the signal from the depressed key is passed through the gate 228 and, if the pilot lamp 234 is turned on by a flip-flop 209, the pilot lamp is reset and turned off by a signal line 232. When the "∞" key 221 is depressed instead of one of the numeric keys 217, the signal from the key 221 is passed through the gate 229 to set the flip-flop 207 and turn on the pilot lamp 234 while, at the same time, the memory 202 is cleared by a signal line 233 if some figure has already been entered into the memory. Thus, entry of a figure into the memory and the "∞" order can never come into existence at a time but, when one of them exists, the other is always non existent.

When the "R" key is depressed, the flip-flop 205 is reset while the flip-flop 206 is set and the gates 230 and 231 are opened. Thereafter, as already described in connection with the depression of the "0 " key, the figure of one of the keys 217 is passed through a gate 231 to the memory 203 and the signal of "∞" key is passed through a gate 230 to set a flip-flop 208 and turn on a pilot lamp 235. Again in this case, if some figure is entered into the memory 203, the flip-flop 208 is reset and conversely, if the flip-flop 208 is set, the memory 203 is cleared. Thus, entry of numeric data into the memory and the "∞" order are automatically changed over therebetween. It is also possible to enter inputs into the two types of memories 202 and 203 by means of keys 217 and 221 of one type.

Relation between Sequence and Mechanical Operation

Figure 3B:
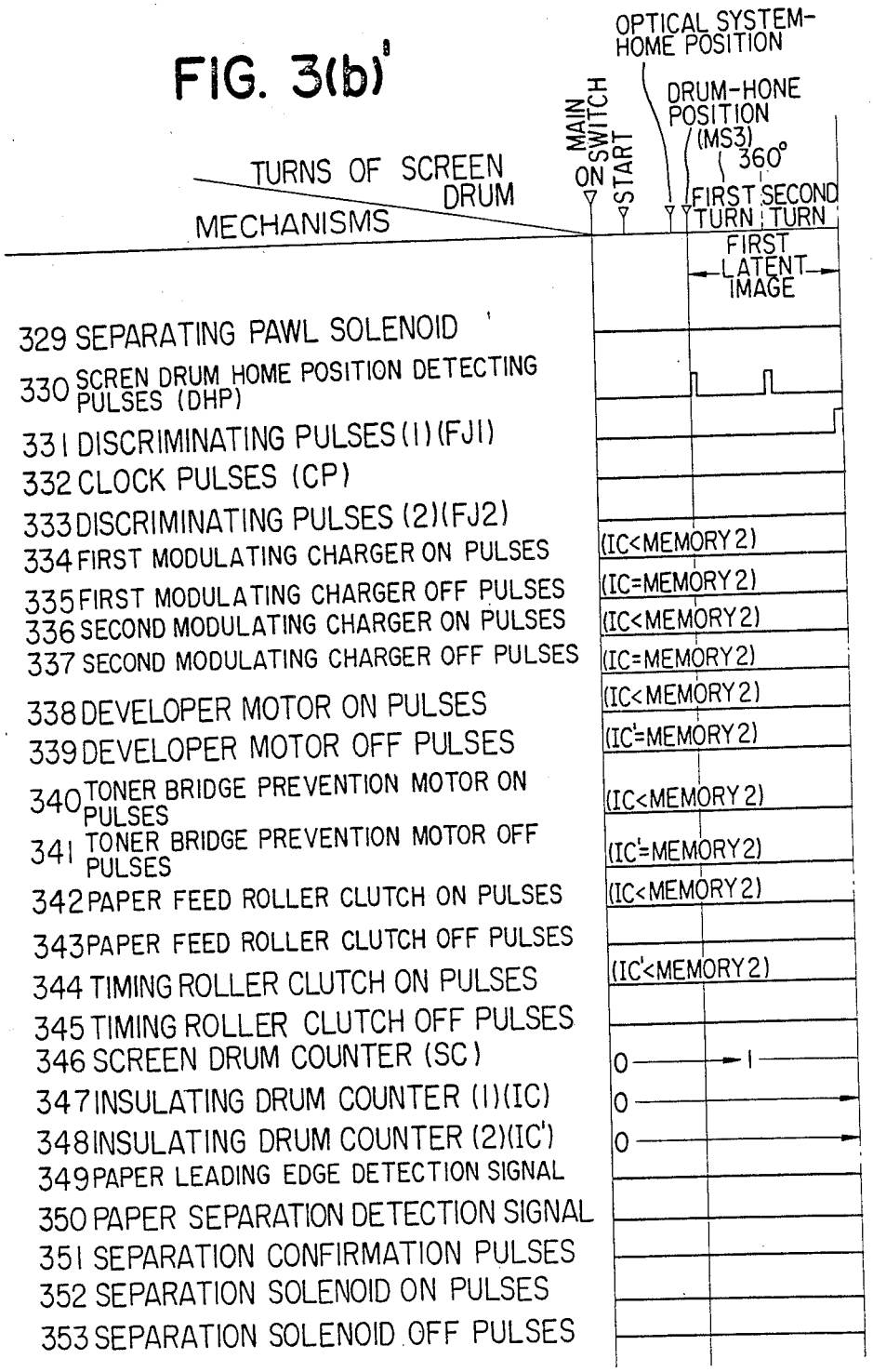
FIGS. 3(*a*), 3(*a*)′, 3(*a*)″, 3(*b*), 3(*b*)′, and 3(*b*)″ combined is a time chart illustrating the operations of various devices in an example of the copying apparatus according to the present invention.
Figure 4A:
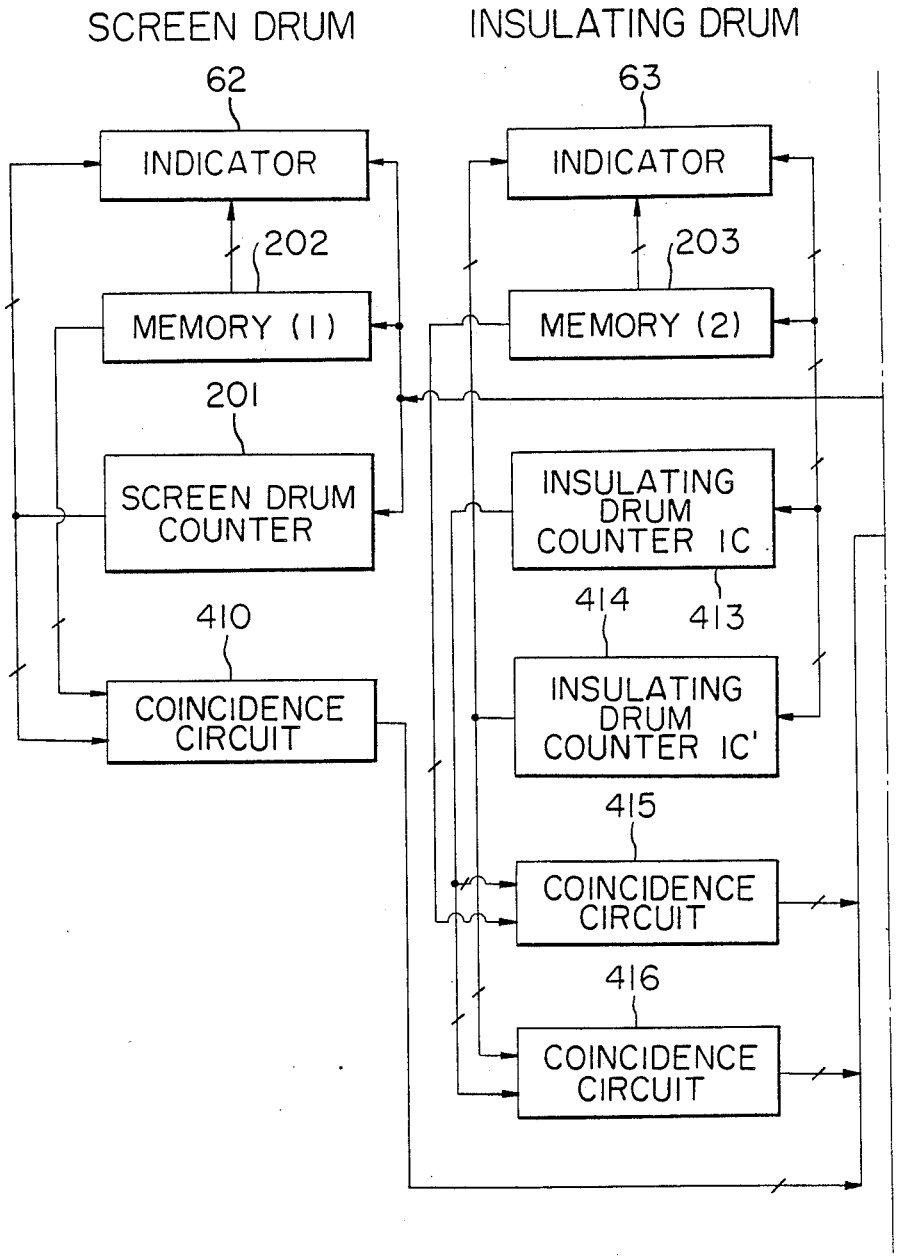
FIGS. 4, 4A, and 4b combined is a block diagram of the control section in an example of the copying apparatus according to the present invention.
Figure 3B:
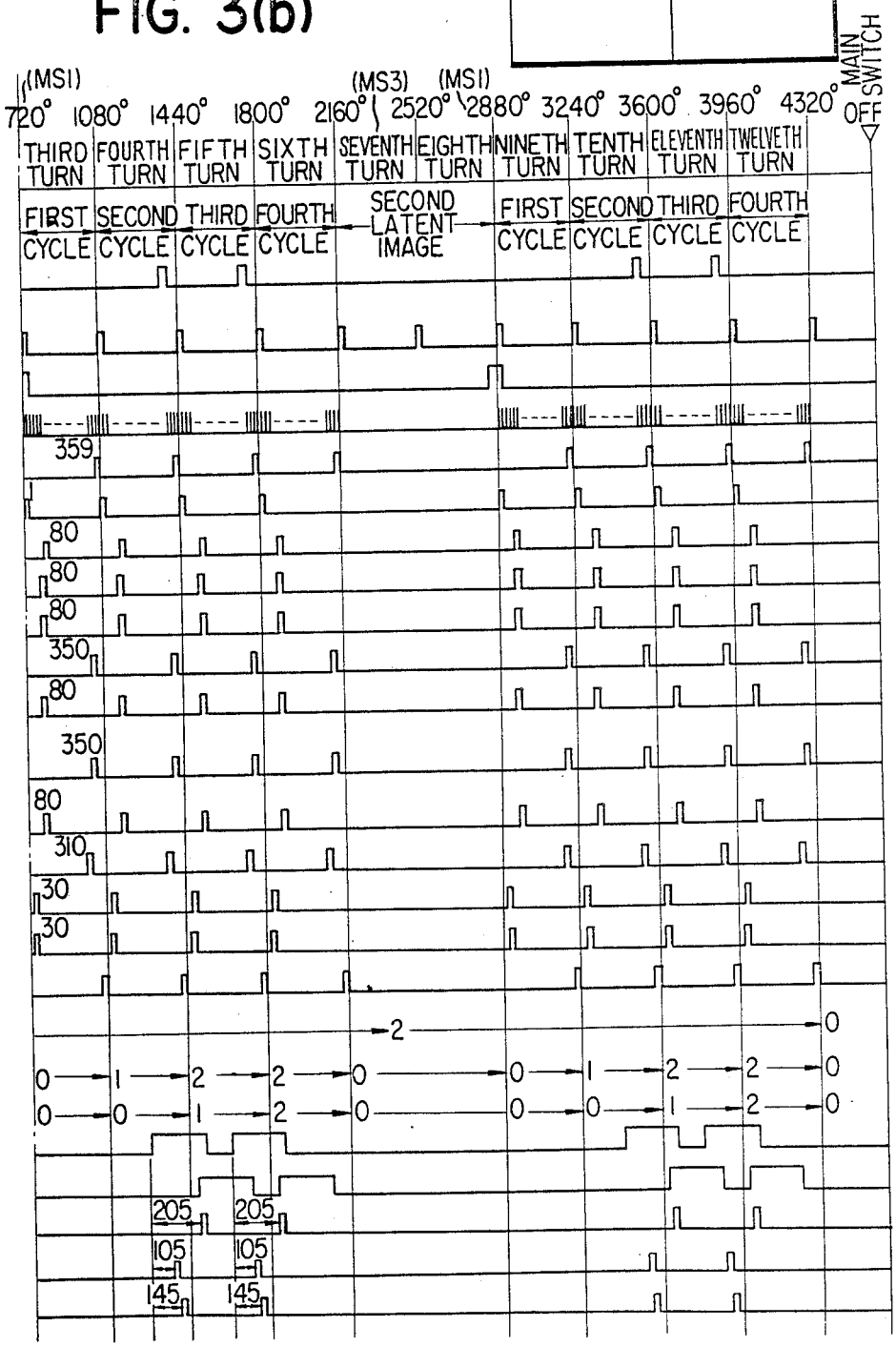

FIG. 3 is a time chart showing the operational sequence of the copying apparatus of FIG. 1 with respect to a case where the orders from the operating board are ORIGINAL <<002 >> and RETENTION <<002 >>. First, upon closing of the main switch, a cleaning motor 320 for collecting the residual toner removed from the insulating drum and for driving the conveyor belt, a dust collector 15 for screen (FIG. 1), a fan 14 for screen dust-proof (FIG. 1), two screen heaters 18 (FIG. 1) and a dust collecting fan 325 for sucking the toner suspended within the developing device are started and driven until the main switch is opened, with the only exception that one of the two screen heaters is deenergized at a point of time whereat formation of a first electrostatic latent image is completed.

Subsequently, when the "START" key for starting the copying operation is depressed, the motor 301 for the screen drum is rotated. Thereupon, the reciprocating clutch for optical system is operated to thereby drive the optical system in synchronism with the screen drum. Describing the mechanism of the optical system by reference to FIG. 1, an original on the original supporting glass is illuminated by the original illumination lamp 52 while this lamp 52 and a first mirror 53 integrally formed with the reflector of the lamp are being moved at a velocity v synchronous with the peripheral velocity of the screen drum 1. As long as the motor for the screen drum is driven during the illumination by the original illumination lamp, the screen drum is rotated at the peripheral velocity thereof but when this motor is deenergized while the motor for insulating drum is energized, both the two drums instantaneously increase their velocities to about twice.

During the rotation of the motor 301 for screen drum, a cooling fan 326 for optical system is driven to prevent the build up of heat in the optical system caused by the turn-on of the pre-exposure lamp 3, the whole surface illumination lamp 7 and the original illumination lamp 52.

Also, closing of the "START" key energizes the charger 36 for toner image transfer, the charger 37 for paper separation, the discharger 50 for insulating drum and the suction fan 319 for paper separation (FIG. 3) and these are deenergized upon completion of the copying operation. However, the potentials of the above-mentioned chargers 36, 37 and 50 are reduced so that no excess charge may be imparted to the insulating drum which is being slowly rotated at the peripheral velocity of the motor for screen drum (317, 318 and 321 in FIG. 3).

Next, after the formation of a primary latent image, the motor for screen drum is deenergized and the motor for insulating drum is energized, whereupon the copying processes such as modulation, development, image transfer, paper separation, etc. are started. After the modulation, a first copy is finished for three complete rotations of the screen drum but thereafter, a copy is finished for each complete rotation of the screen drum.

Describing this by reference to FIG. 3, the rotation of the drum is first changed over to the motor 328 for insulating drum and simultaneously therewith, the first modulating charger 310 and the clutch 316 for conveying roller for transmitting the drive of the cleaning motor 320 to the conveyor belt 38 (FIG. 1) are energized. As the screen drum progressively rotates through 80° from its home position, the second modulating charger 311 for transferring the electrostatic latent image from the screen drum to the insulating drum is energized; when the screen drum rotates to an angular position of 310°, the clutch 314 for paper feed roller for feeding a sheet of copy paper from the paper feed table is energized; and when the screen drum rotates to an angular position of 350°, the motor 312 for developer and the reversible toner bridge prevention motor 313 for agitating the toner staying in the developing device are energized. After the modulation is started, the screen drum enters a second cycle of rotation and when it comes to the position of 30°, the clutch 314 for paper feed roller is deenergized, whereby the clutch 315 for timing roller is energized to bring the leading edge of the fed paper into coincidence with the leading edge of the developed visible image on the insulating drum. If the number of copies desired is one, the first 310 and the second modulating charger 311 are deenergized when the screen drum is at the position of 80°, but in the present case, these chargers are not deenergized because the number of copies desired is two. As the screen drum further rotates to the position of 310°, the clutch 314 for paper feed roller is energized to feed a second sheet of copy paper. At the position of 360°, the clutch 315 for timing roller for the first sheet of copy paper is deenergized. A third cycle of rotation is entered and when the screen drum comes to the position of 30°, the clutch 314 for paper feed roller is deenergized and the clutch 315 for timing roller for the second sheet of copy paper is energized. At the position of 80°, the first 310 and the second modulating charger 311 are deenergized. If the number of copies desired is one, the motor 312 and the toner bridge prevention motor 313 are deenergized at this point. At the position of 360°, the clutch for timing roller is deenergized. A further cycle of rotation is entered and when the screen drum comes to the position of 80°, the motor 312 for developer and the toner bridge prevention motor 313 are deenergized. At the position of 360°, the motor 328 for insulating drum and the clutch 316 for conveying roller are deenergized, thus completing the retention cycle.

A separating pawl solenoid 329 for separating paper from the insulating drum (indicated by 73 in FIG. 1) becomes operative at the position shown in FIG. 3, by the pulses being counted from the point of time whereat the leading edge of the paper passes between the lamp 69 and the light receiving element 70 (FIG. 1).

When all the copying operation has been completed, an electromagnetic brake 327 is temporally operative to brake the drum against overrunning.

Arrangement of the Sequence Control Circuit

Figure 4B:
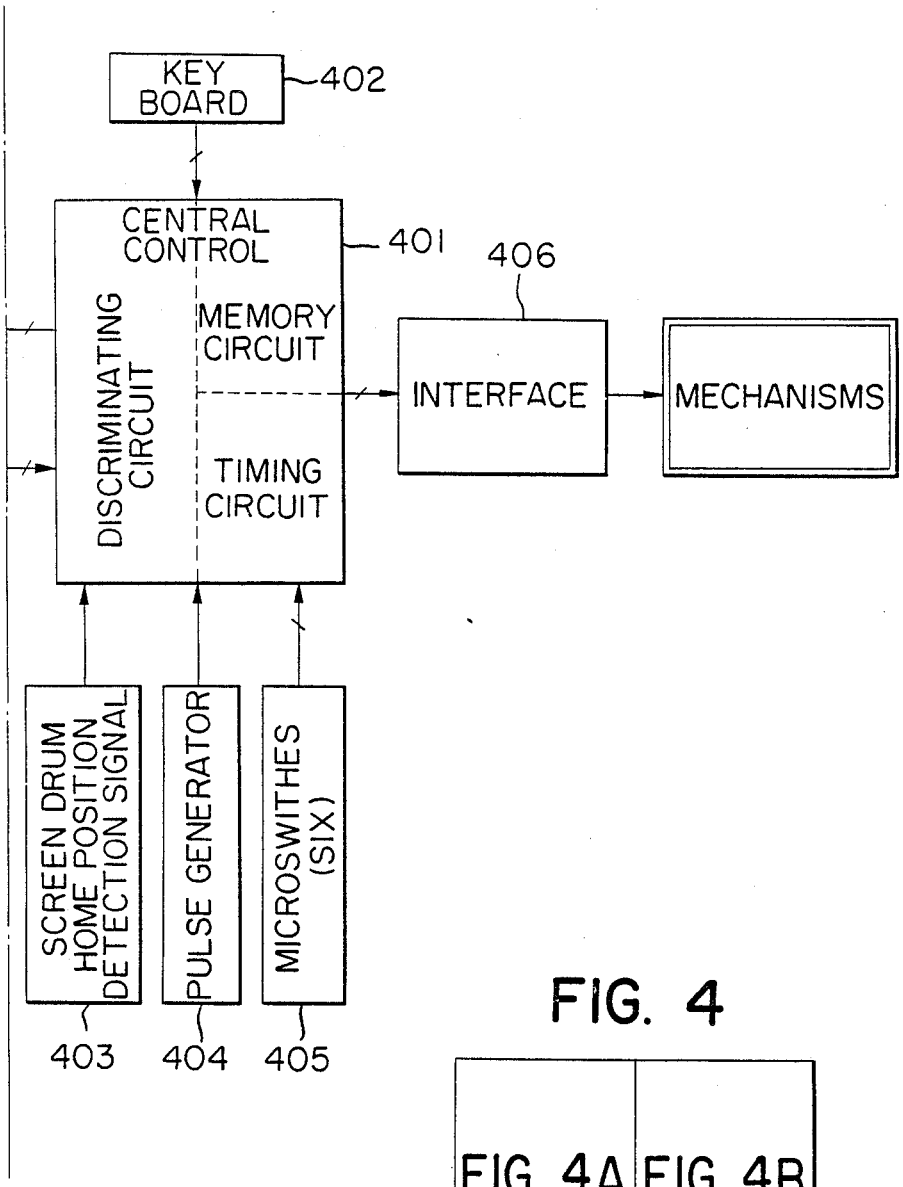
Figure 4:
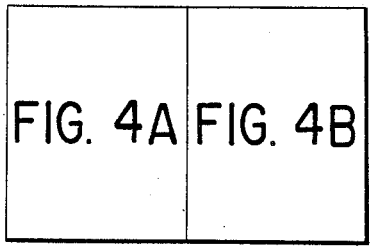

FIG. 4 is a block diagram of the control section. There are applied from outside to the central control 401 signals from the keyboard 402 giving operational orders, detection signal 403 for the home position of the screen drum which forms the reference for the sequence, a series of clock pulses 404 from a clock pulse generator synchronous with the rotation of the insulating drum, and six microswitch signals 405 determining the timing of primary latent image formation. In accordance with these input signals, the central control drives two memories and three counters to effect storage and judgment and put out proper signals to an interface 406.

The screen drum home position is obtained in the form of detection pulse 330 (FIG. 3) by the magnet 68 and magneto-electric conversion element 67 (FIG. 1) on the screen drum for each complete rotation of the screen drum. Discriminating pulses (1) 331 are provided from the time when an electrostatic latent image has been formed on the screen drum until the optical system comes back to its home position MS1 and thereafter, the screen drum comes to its home position. During the time when such discriminating pulses (1) 331 are generated, judgment is effected as to whether the contents of the memory (1) 202 and the screen drum counter 409 are equal or not and whether the "STOP" order has been given or not, whereby the motor for insulating drum is started to initiate the process of secondary latent image formation or to restart the primary latent image formation or to stop the motor for screen drum, thereby determining whether or not to terminate the sequence.

Figure 5:
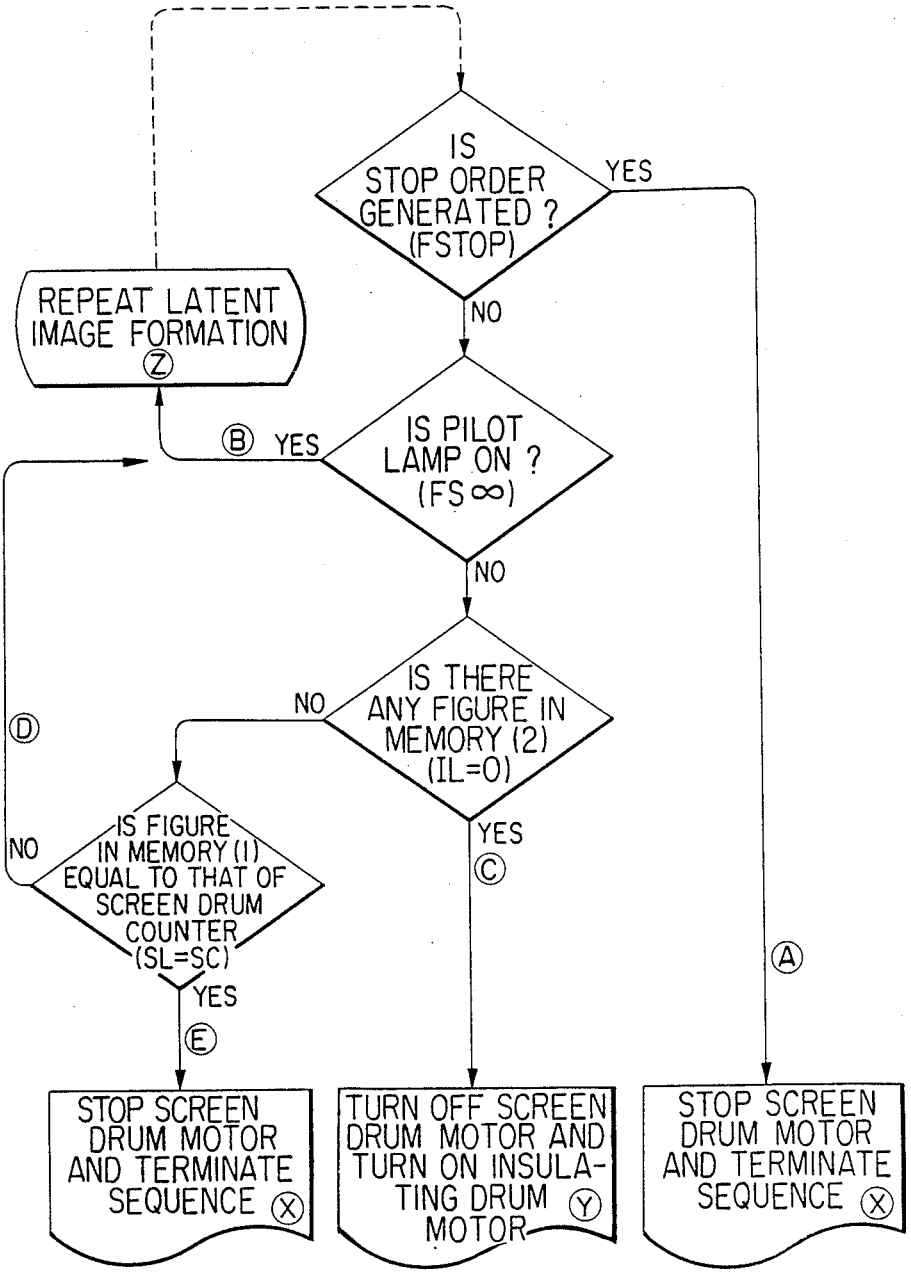
FIG. 5 is a flow chart of the sequence judgement.
Figure 6:
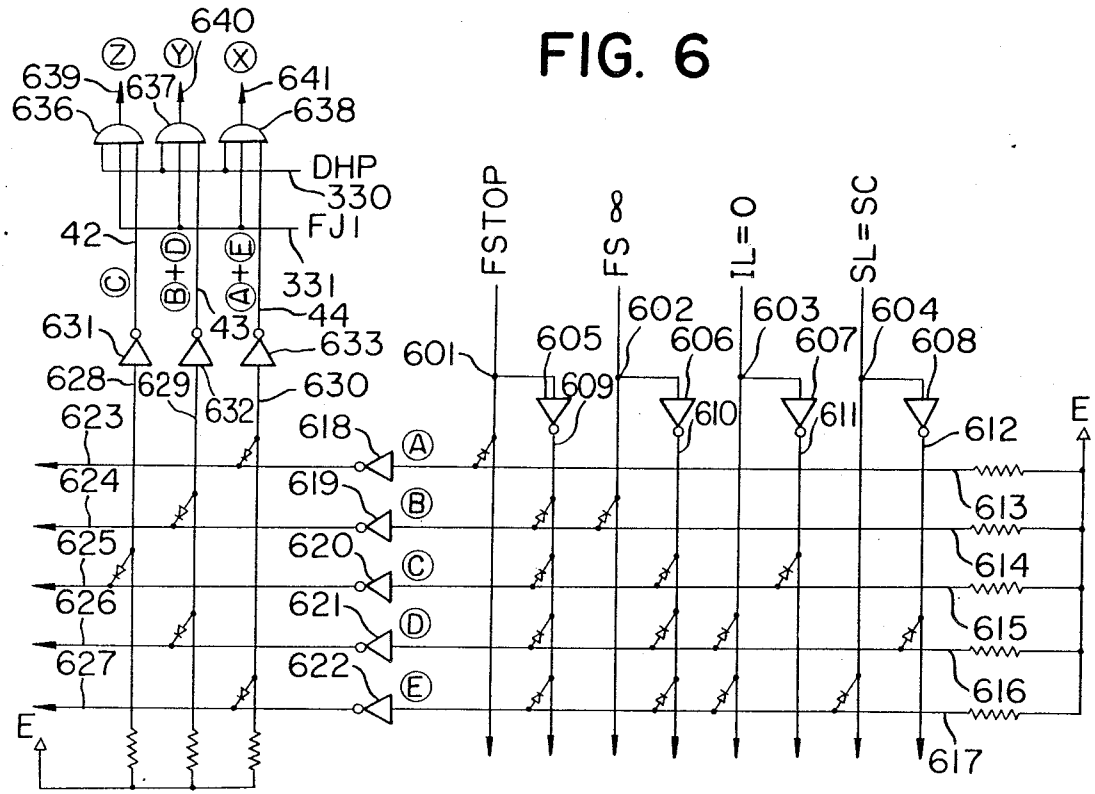
FIG. 6 diagrammatically shows an example of the circuit realizing the sequence judgement of FIG. 5.

Such determinations may be expressed in a flow chart as shown in FIG. 5. As seen there, these determinations are successively indicated by Y, Z and X. Further, this flow chart may be represented in the form of an electric circuit diagram as shown in FIG. 6. Define the vertical bus bars as columns and the lateral bus bars as lines. The control orders indicated by ◇ are connected to columns 601–604, respectively. Also, these signals are inverted by inverters 605–608 and connected to columns 609–612. Lines 613–617 are connected to the power source through resistors. This power source must be at a level equal to the logic level "1".

Figure 20:
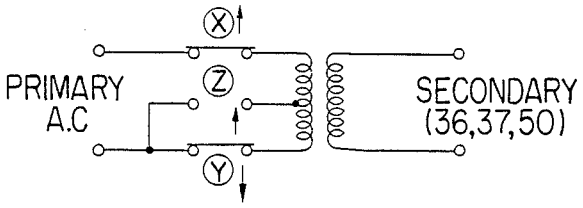
FIG. 20 shows an example of the control circuit for the output side of the charger.

For example, the condition Ⓒ in FIG. 5 is that "there is no STOP order given, the pilot lamp 1 is not turned on and a figure is in the memory 2" and therefore, this may be expressed by a logic equation "$Ⓒ = \overline{FSTOP} \cdot \overline{FS_{\infty}} \cdot \overline{IL} = \overline{0}$". Thus, if diodes are inserted in columns 609, 610, 611 and line 615 in the senses as shown, there is formed an AND gate in which line 615 is at the "1" level only when columns 609–611 are at the "1" level. In other words, line 615 assumes the "1" level when the condition Ⓒ is established. Likewise, conditions Ⓐ to Ⓔ are put out onto lines 613–617. Further, these lines 613–617 are inverted by inverters 618–622 and connected to lines 623–627. If columns 628–630 intersecting these lines 623–627 are connected through registers to the power source E to form a diode matrix again, line 630 assumes the "0" level only when the condition "Ⓐ or Ⓔ" is established, and the output 644 of inverter 633 becomes as expressed by a logic equation "Ⓐ + Ⓔ" and assumes the "1" level only when the aforementioned condition is established. Accordingly, if this is passed to gate 638 with control pulse (1) FJ1 331 and screen drum home position pulse DHP330 which represents the break point of operation, the operation order "X" representing the termination of the sequence may be given to latch the memory circuit. Other signals Y and Z may likewise by given. In the case of signal Z, the outputs of the aforementioned chargers 36, 37 and 50 are reduced in the manner as shown in FIG. 20.

When the condition Ⓒ is established and signal Y is obtained, the motor for screen drum is deenergized while the motor for insulating drum is started and the velocity of the drum is changed to high level and the disc 59 is rotated by gearing in synchronism with the drum. Signals generated by apertures formed circumferentially of the disc 59 traversing the clearance between a pair of light emitting element and light receiving element 60 are taken out as clock pulses 332 (FIG. 3). These clock pulses are generated in such a manner that a pulse is generated per 1° rotation of the screen drum and 360 pulse are generated per 360° rotation of the screen drum. Since it is difficult to form an aperture per 1° in a disc having the same diameter as that of the screen drum, there is provided another disc whose number of revolutions is made as great as n times that of the screen drum by gearing and which is formed with 1/n apertures.

In the present apparatus, during the processes subsequent to the modulation, these clock pulses are processed for use as driving signals for various devices. During the processes subsequent to the modulation, as shown in FIG. 3, the first copy sheet is finished for one complete and half turn of the insulating drum and the second and subsequent copy sheets are finished for each half of one complete turn of the insulating drum and therefore, with one-half turn of the insulating drum or one complete turn of the screen drum as the reference for the sequence control, a binary coded 360-counter is operated by the clock pulses 332 to put out the control pulses 333–345 shown in FIG. 3.

Figure 7:
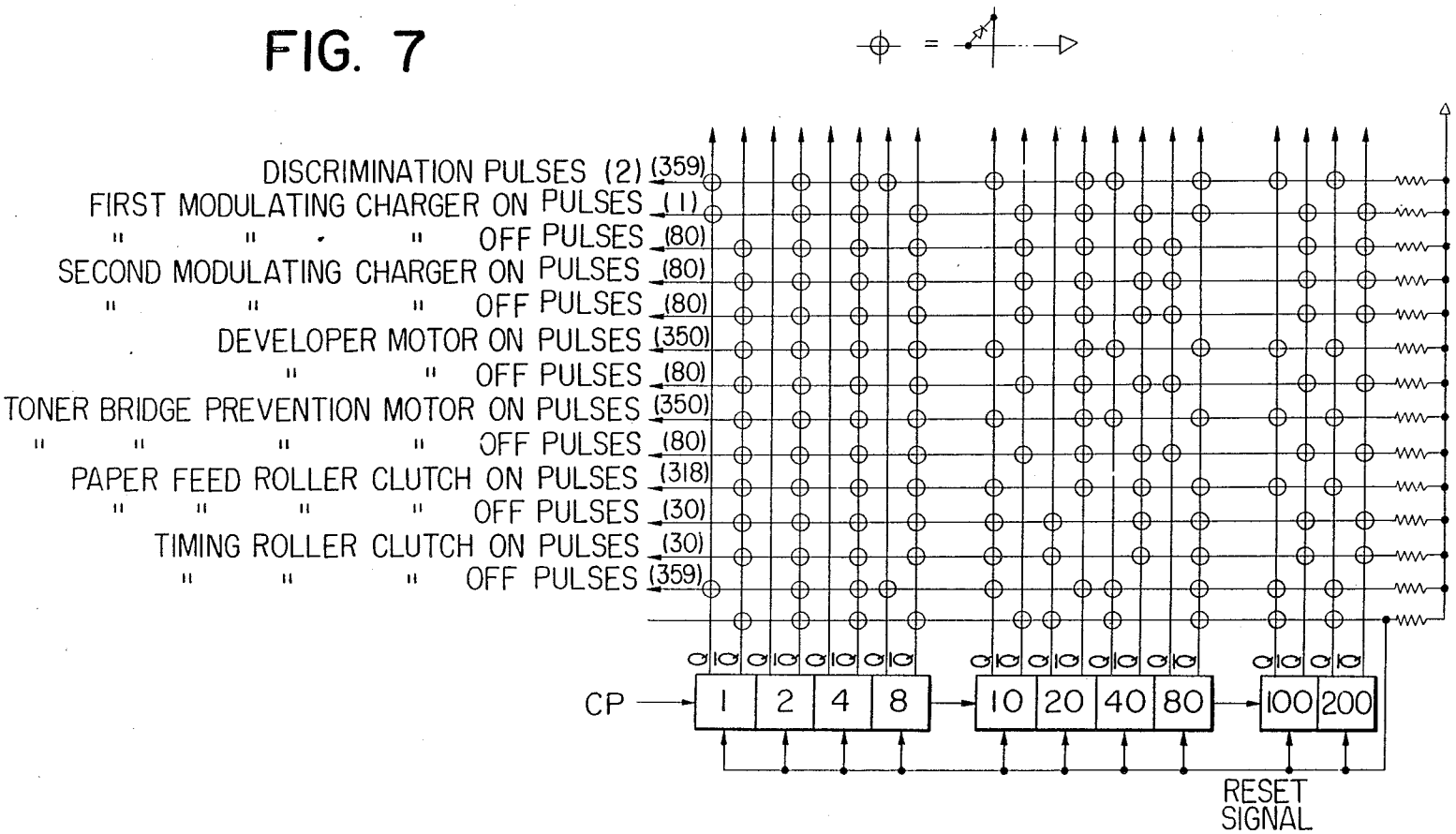
FIG. 7 diagrammatically illustrates the driving circuits for various devices.

An example of the circuit for generating such control pulses is shown in FIG. 7. Ten flip-flop are connected together to constitute a 360-counter which may count clock pulses from 0 to 359. The first four flip-flops constitute a decimal counter which represents the place having the weight of 1 and repeats counting from 0 to 9, the next four flip-flops constitute a decimal counter which represents the place having the weight of 10 and repeats counting from 0 to 9, and the last two flip-flops constitute a trinary counter which represents the place having the weight of 100. However, when the count advanced from 0 changes from 359 to 360, a set signal is put out from a decoder to reset all the flip-flops. Thus, these flip-flops provide a 360-counter which repeats counting from 0 to 359 for each complete turn of the screen drum from its home position. The control pulses 333–345 in FIG. 3 are generated by the output of the above-mentioned counter being decoded by the matrix circuit (decoder) of FIG. 7. Where it is desired to alter the timing of the sequence of 310 to 316 in FIG. 3, this may be accomplished by changing the locations of the diodes in the decoder as desired. For example, delicate adjustment such as the timing of the paper feed or the registration between the leading edge of the paper and the developed visible image on the drum which could not be accomplished by a microswitch-cam combination may be readily accomplished.

The other control pulses are put out in a similar manner.

In FIG. 3, selection of the control pulses is necessary in order that the first modulating charger 310 may be energized at count 1 in the first cycle and if the number of copies desired is one, may be deenergized at count 80 in the second cycle and if the number of copies desired is two, may be deenergized at count 80 in the third cycle.

The present invention, as shown in FIG. 4, uses two insulating drum counters IC and IC' to count the discriminating pulses (2) and compare the counter number with the memory (2), thereby facilitating the selection of the control pulses.

More specifically, the insulating drum counter IC 347 foreffecting count "1" from the second cycle is operated so that, if the number counter by this counter is equal to the memory (2) which stores the desired number of copies, the ON signal during that cycle is killed. After that, this counter is stopped.

It is to be noted here that, for example, the clutch for timing roller is operated for the first sheet of paper for the first time in the second cycle. However, when compared with the memory (2), the insulating drum counter IC becomes equal to the memory (2) in the third cycle and thus, this clutch is not operated for the second sheet of paper. Therefore, according to the present invention, the insulating drum counter IC' which counts up with a delay of one count with respect to the counter IC is compared with the memory (2) to thereby control ON-OFF of the above-mentioned clutch.

In the case of FIG. 3, the insulating drum counter IC coincides with the memory (2) in the third cycle and stops counting, whereas the insulating drum counter IC' coincides with the memory (2) in the fourth cycle. Thus, the insulating drum counters (1) and (2) coincide with each other in the fourth cycle. The coincidence between these two counters means the last cycle of copying, and during the last time of that cycle, namely, during the time of discriminating pulse (2), the two counters are cleared to confirm whether or not the screen drum counter is again coincident with the memory (1) storing the number of times of latent image formation and if they are coincident, a copy terminating order is put out to stop the drum from rotating. If not coincident, the motor for insulating drum is deenergized and the motor for screen drum is energized to start the exposure, whereafter the same sequence as that after the primary latent image formation is repeated.

Figure 16:
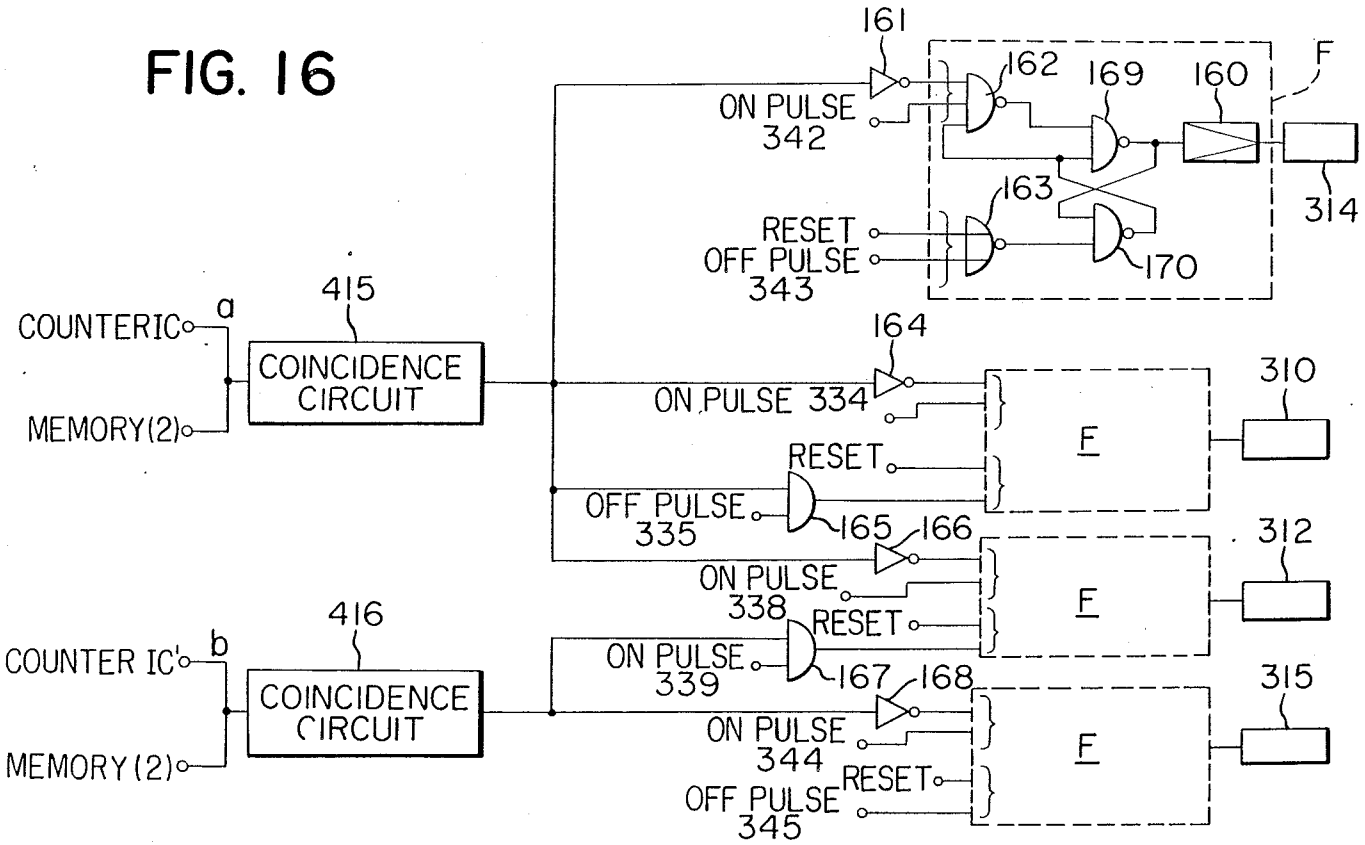
FIG. 16 shows an exmample of the driving circuit for the devices shown in FIG. 3.

FIG. 16 shows examples of the drive controls for various devices. In this FIGS. 310, 312, 314 and 315 respectively correspond to the clutch for paper feed roller, the first modulating charger, the motor for developer and the clutch for timing roller shown in FIG. 3. Designated by 160 is an amplifier for operating these. There are further seen the gates 167 and 170 of flip-flops, inverters 161, 164, 166 and 168, NAND gate 162, NOR gate 163 and AND gates 165 and 167. When the coincidences between the aforementioned counters IC, IC' and the copy number setting memory (2) are discriminated by the respective coincidence circuits, ON pulses are interrupted and the devices are stopped by OFF pulses. Thus, the devices can be controlled with a predetermined timing.

It is further to be noted that if the process concerned is the sequence of steps of latent image formation or the like and control pulse is generated for each process, the necessary control pulse corresponding to each process may be selected according to the above-described method.

Also, if the developing device is of the liquid developing type, the step of idle rotation cleaning of the insulating drum before the formation of secondary latent image and the step of idle rotation cleaning of the same drum after the image transfer may be provided to ensure the next image formation is good. More particularly, it will become possible to prevent the difficulties which would otherwise be encountered in the cleaning of the insulating drum during the next cycle as the result of the liquid on the surface of the drum or the toner on the cleaning blade 48 (FIG. 1) being dried up. Exposure of the rotating insulating drum to AC corona discharge would result in a better effect. The pre-rotation of the drum may provide the rotation of primary latent image formation. It will also become possible to form the control pulse according to the above-described method so that the post-rotation may be substantially one complete rotation.

Figure 8:
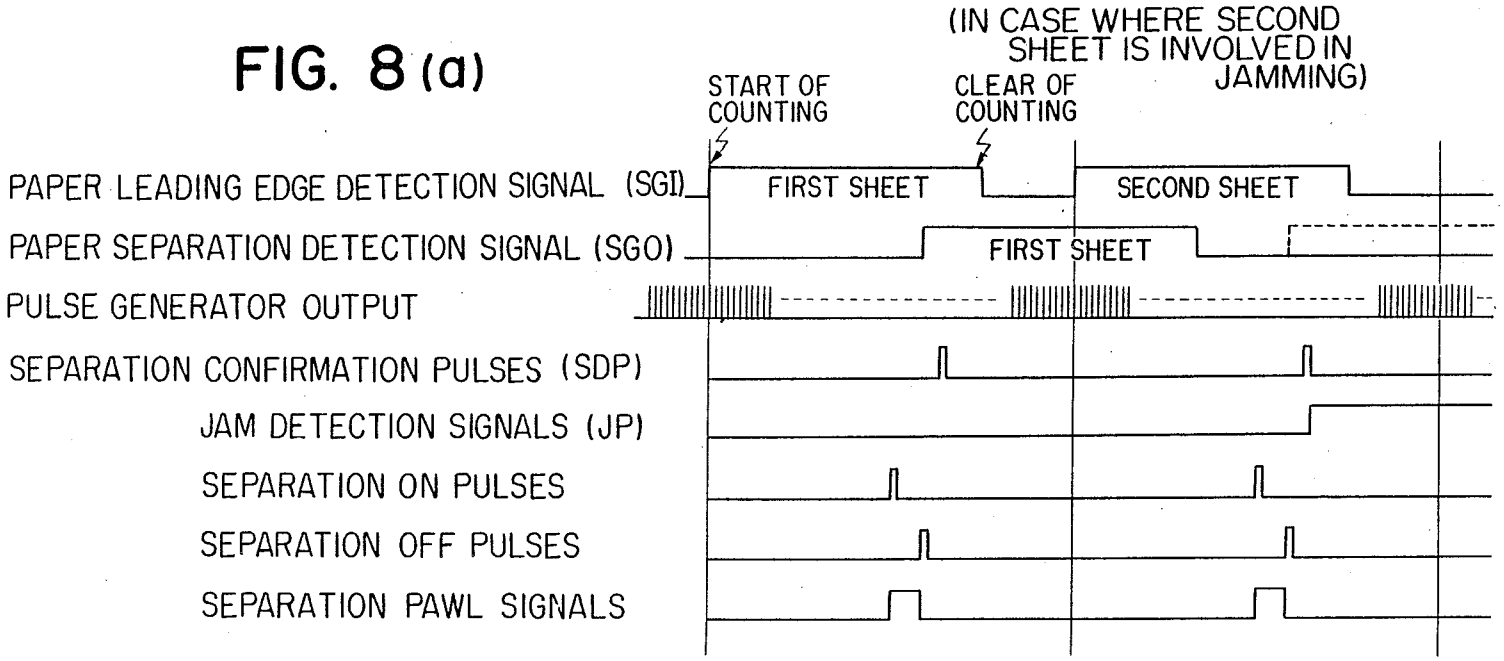
FIGS. 8(*a*) and 8(*b*) are a time chart and a circuit diagram, respectively, illustrating the jam detecting operations.
Figure 8:
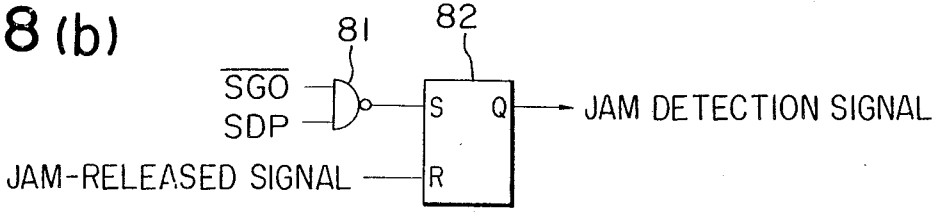

Reference will now be had to FIG. 8 to explain some cases where copy paper jams. If copy paper clogs in its path of conveyance or if copy paper after image transfer is not successfully separated from the insulating drum but moved therewith, or if two sheets of copy paper have been fed at a time, the jam resulting therefrom may be detected by a pair of light source 69 and light receiving element 70 and a pair of light source 71 and light receiving element 72 provided as shown in FIG. 1. When the leading edge of the copy paper passes by the light source 69 (SGI), the pulse from the aforementioned clock pulse generator is picked up by the light receiving element 70 to start the jam counter and, when the leading edge of the copy paper passes by the light source 71 (SGO), the light receiving element 72 puts out separation confirmation detection pulses SDP comprising the decoded output of the jam counter. The counted number of the detection pulses corresponds to the conveyance distance from the light source 69 to the light source 71. Therefore, if copy paper clogs in its path of conveyance or fails to be separated from the insulating drum, the copy paper does not intercept the light source 71 in spite of the separation detection pulses being put out. Accordingly, a jam detection signal JP is put out along a circuit as shown in FIG. 8(*b*). It is also possible to utilize this counter to cause the same decoder to put out a pulse signal for creating a timing with which the separation pawl 73 (FIG. 1) may be operated.

Figures 9, 9A:
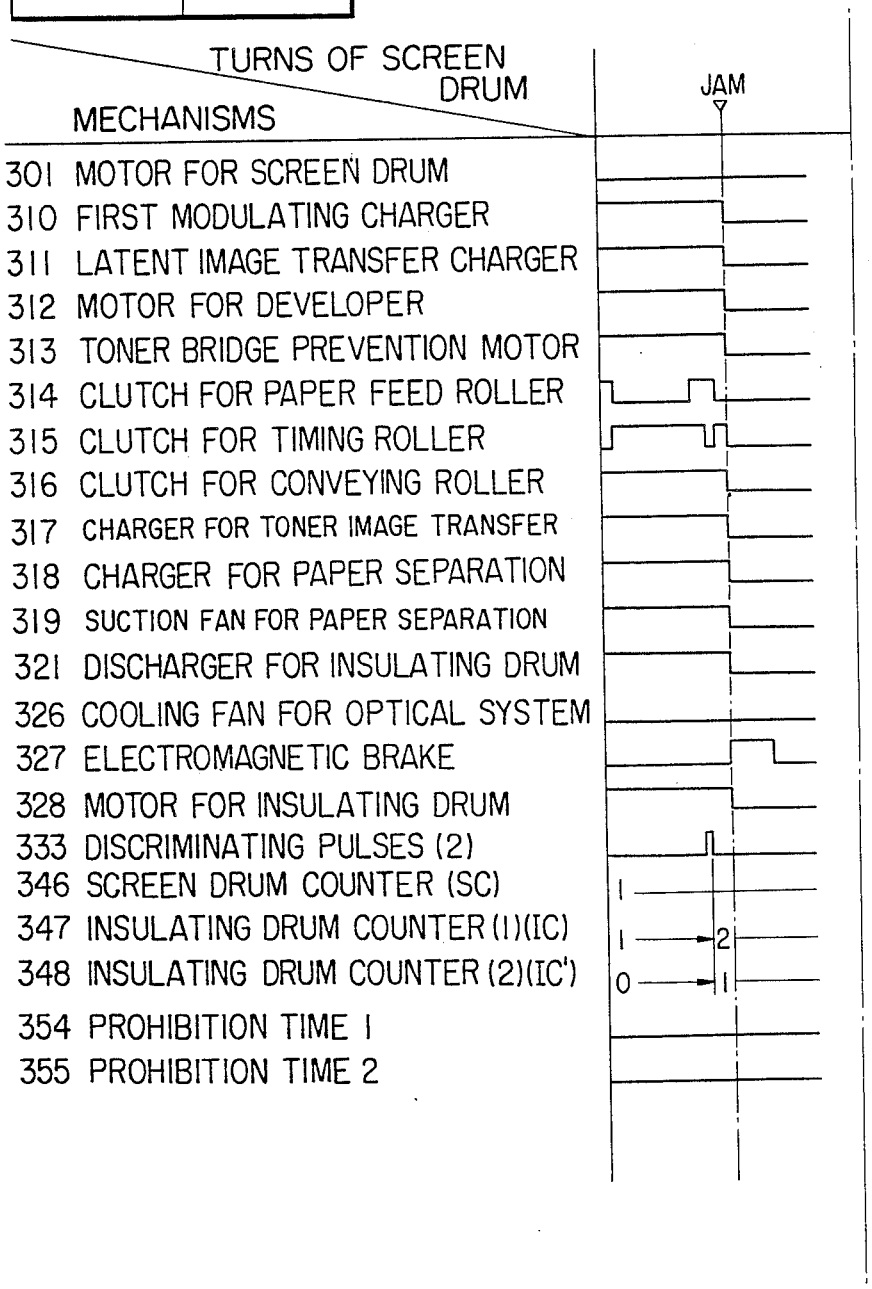
FIGS. 9, 9A, and 9B combined is a time chart illustrating the operations of various devices after the jam detection.
Figure 9B:
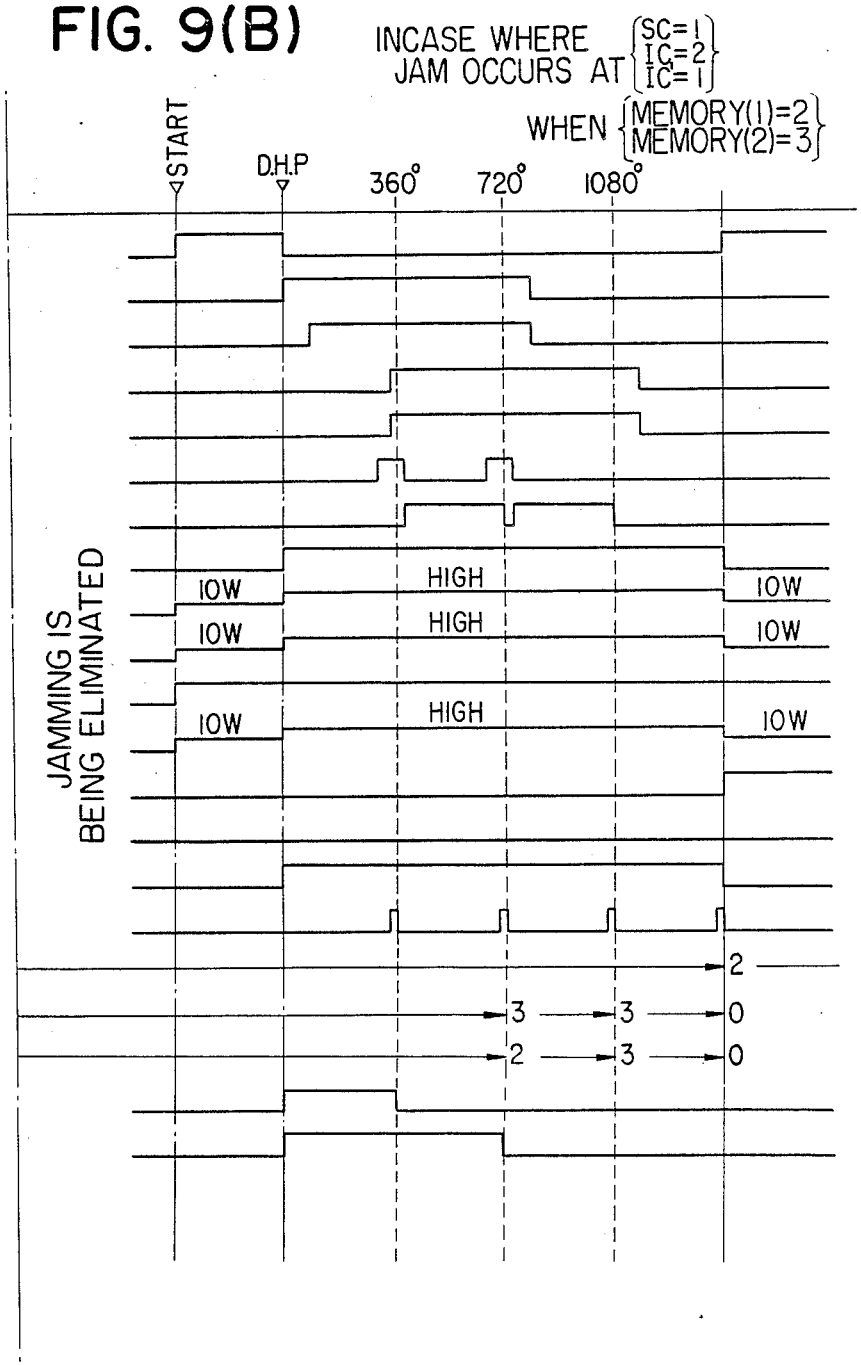

Reference will now be had to FIG. 9 to discuss the sequence control unique to the present invention which takes place after jam detection.

As soon as jam occurs, the electromagnetic brake is used to suddenly stop the motor for insulating drum and thereby stop all the sequences, thus enabling repair to be done without the main switch being opened. During the repair, the counter remains stationary while displaying the number counted as of the point of time whereat the jam occured. If the "START" key is again depressed upon completion of the repair, the motor for screen drum is energized to rotate the screen drum to its home position and in this home position, the motor for screen drum is deenergized while the motor for insulating drum is energized. Since the electrostatic latent image on the screen is retained even during the repair, the sequence subsequent to the modulation is resumed. Describing the details of the timing by reference to FIG. 9, the sequence subsequent to the modulation requires the insulating drum to effect one complete and half rotation (three complete rotations of the screen drum) regardless of the original first sheet or of the first sheet for the restart after the jam. Therefore, in the case of the restart after the jam, it is necessary to create the timing of the sequence for the first sheet after the modulation while the insulating drum counters IC1 and IC2 remain stationary. For this reason, prohibition time 1 and prohibition time 2 are provided for in the first and the second cycle of the sequence, as shown in FIG. 9, thereby effecting the control of the sequence for the first sheet. The insulating drum counters (1) and (2) effect count-up from the beginning of the third cycle and the sequence control thereafter is effected in the same manner as the ordinary control.

It is considered that jam may occur in the following cases: ① when the first sheet jams, namely, when the insulating drum counters (1) IC and (2) IC' are not equal to the memory (2); ② when the insulating drum counter IC is equal to the memory (2); and ③ when the insulating drum counter IC8 is equal to the memory (2).

The movements of the counters in the case of the restart after jam are illustrated below, it being understood that memory (2)=4.

| ① | | JAM | START | | | 3 CYCLES | | | | |
|---|---|---|---|---|---|---|---|---|---|---|
| IC | 0 | 1 | 1 | 1 | 1 | 2 | 3 | 4 | 4 | 0 |
| IC' | 0 | 0 | 0 | 0 | 0 | 1 | 2 | 3 | 4 | 0 |
| PROHIBITION TIME 1 | | | | | | | | | | |
| PROHIBITION TIME 2 | | | | | | | | | | |
| NO. OF COPIES | | 1st sheet jams | | | | one | two | three | four | |
| ② | | | | | | | | | | |
| IC | 3 | 4 | 4 | 4 | 4 | 4 | 0 | | | |
| IC' | 2 | 3 | 3 | 3 | 3 | 4 | 0 | | | |
| NO. OF COPIES | two | 4th sheet jams three | | | | four | | | | |
| ③ | | | | | | | | | | |
| IC | 4 | 4 | 4 | 4 | 4 | 4 | 0 | | | |
| IC' | 3 | 4 | 4 | 4 | 4 | 4 | 0 | | | |
| NO. OF COPIES | two | 4th sheet jams three | | | | | | | | |

In the case ①, both the counters IC and IC' effect count-up from the third cycle. In the case ②, only the counter IC' effects count-up in the third cycle until IC=IC', this terminating the case at the end of the third cycle. In the case ③, count-up is not effected even when the third cycle is entered, and IC=IC' is confirmed at the end of the third cycle, thus terminating the case. As viewed from the results, the cases ② and ③ come to an end in the same cycle and this is because the difference between the cases ② and ③ results from the time difference between the point of time whereat jam occurs near the paper leading edge detector due to two sheets having been fed at a time and the point of time whereat jam occurs due to unsuccessful separation of the paper, even if the paper sheets are of the identical type.

Description will now be made of the sequence control method using the prohibition time (INH1) and the prohibition time 2 (INH2). In the sequence restarted after jam, the first sheet must be printed anyhow and therefore, in the prohibition time 1, the elements 310–314 in FIG. 3 must be energized with a proper timing. The element 315 must also be energized with a proper timing of $\overline{INH1}$, INH2 ($\overline{INH1}$ is the inverted signal of INH1). Subsequently, during the time of $\overline{INH1}$·INH2, the elements 310 and 311 are deenergized if the contents of the counter IC has already become equal to the contents of the memory (2), and the element 314 is also deenergized in such case. In the cycle after INH2, the counters IC and IC' are controlled in the manner as already described and therefore, control is effected by the comparison between the memory (2) and these two counters as is the ordinary control.

Figure 18:
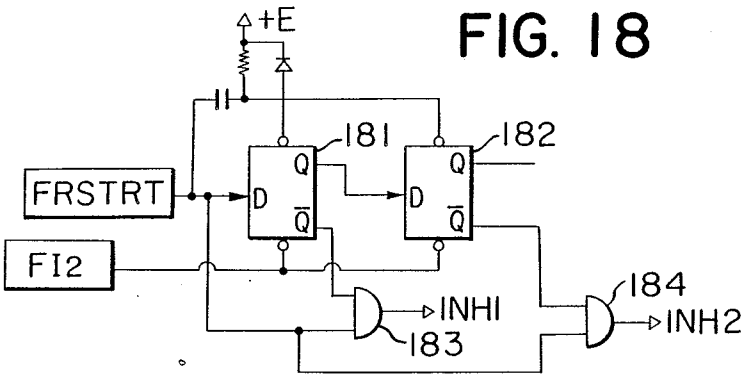
FIG. 18 diagrammatically shows an example of the circuit for generating prohibition time signals when jam occurs.
Figure 21:
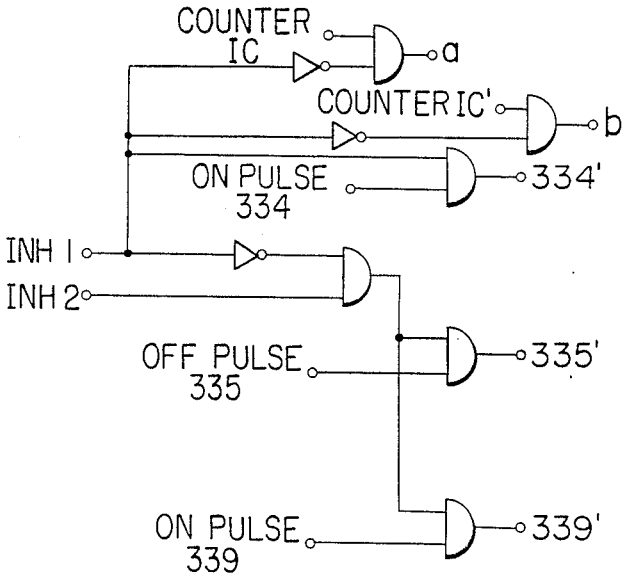
FIG. 21 shows an example of the signal generating circuit using the circuit of FIG. 18 and corresponding to FIG. 16.
Figure 22A:
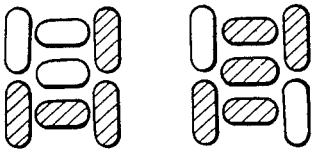
FIGS. 22(*a*), 22(*b*), 22(*c*), 22(*d*), and 22(*e*) shows some examples of the display effected by the display device of the present invention.
Figure 22B:
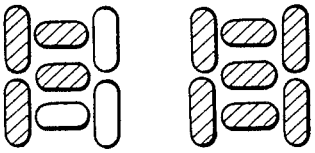
Figure 22C:
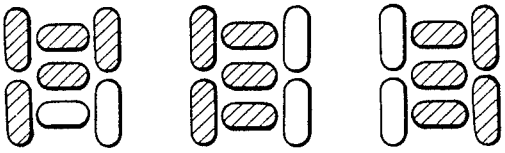
Figure 22D:
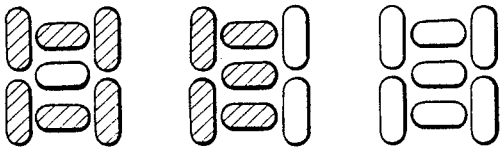
Figure 22E:
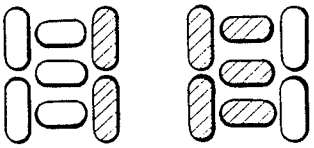

The circuit for generating the prohibition time signals INH1 and INH2 is shown in FIG. 18, where there are seen flip-flops 181, 182, gates 183, 184, start signal FRSTRT concerned with starting of the insulating drum, and discriminating pulse (2) FJ2. The gates 183 and 184 put out INH1 and INH2 with the timing as shown in FIG. 9. The driving of the devices and the stoppage of the counters during these prohibition times are controlled by a circuit as shown in FIG. 21. In this Figure, the ON and the OFF pulses are the same as the sequence pulses in FIG. 3.

Figure 10A:
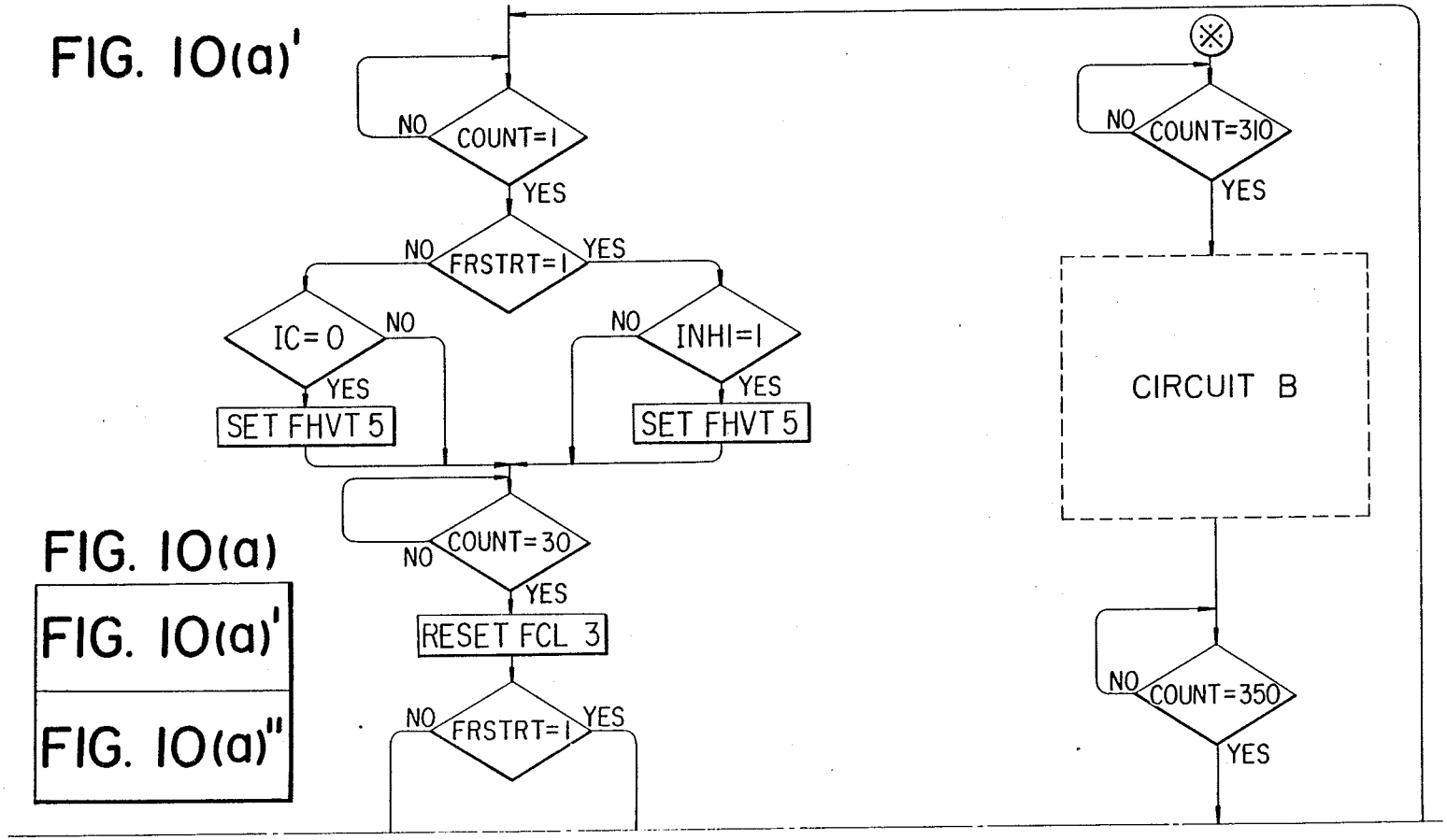
FIGS. 10(*a*), 10(*a*)′, 10(*a*)″, 10(*b*), 10(*c*), 10(*d*), 10(*e*), 10(*e*)′, 10(*e*)″, and 10(*e*)‴ are more detailed flow charts of the sequence judgement.
Figure 10B:
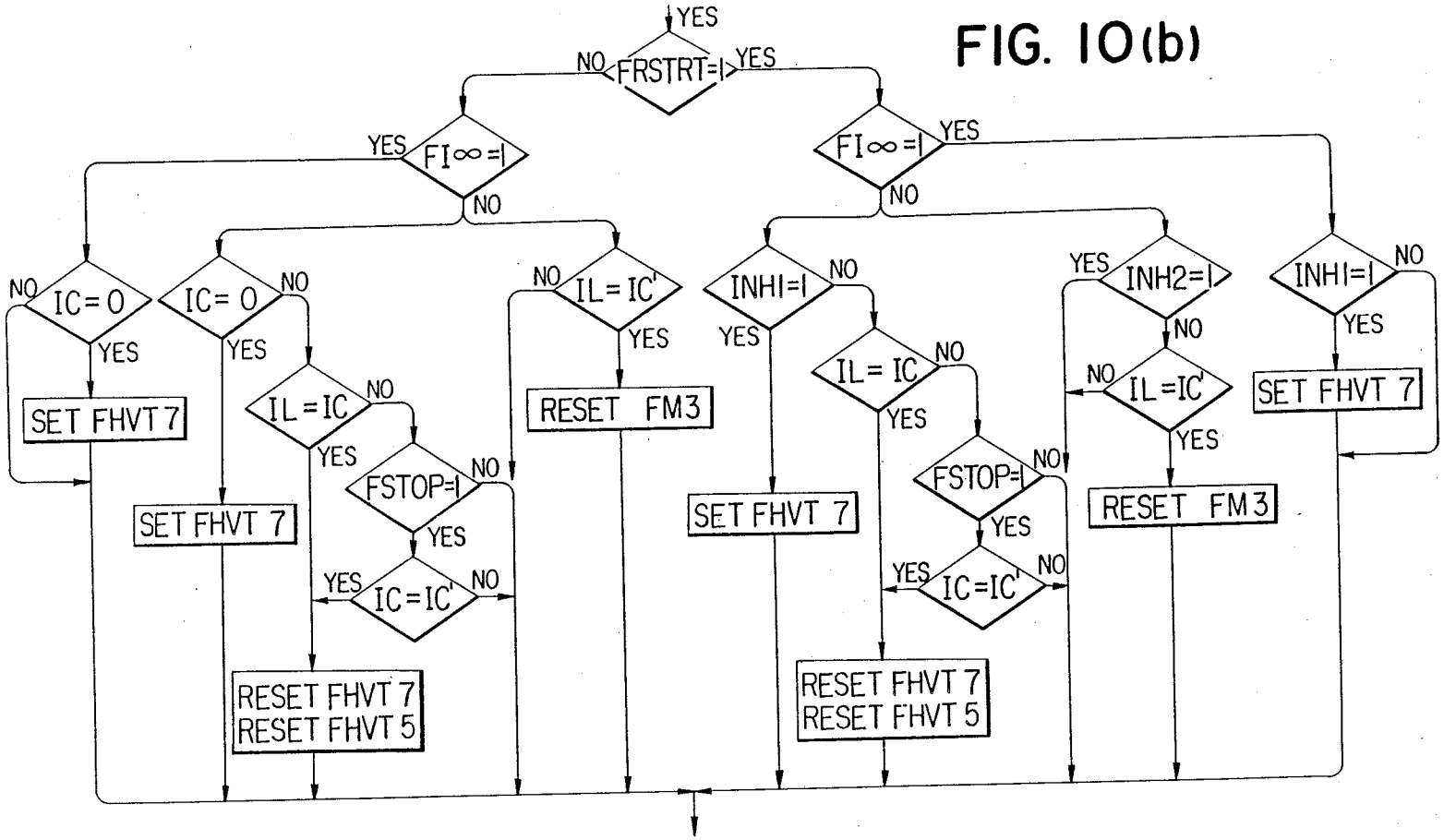
Figure 10C:
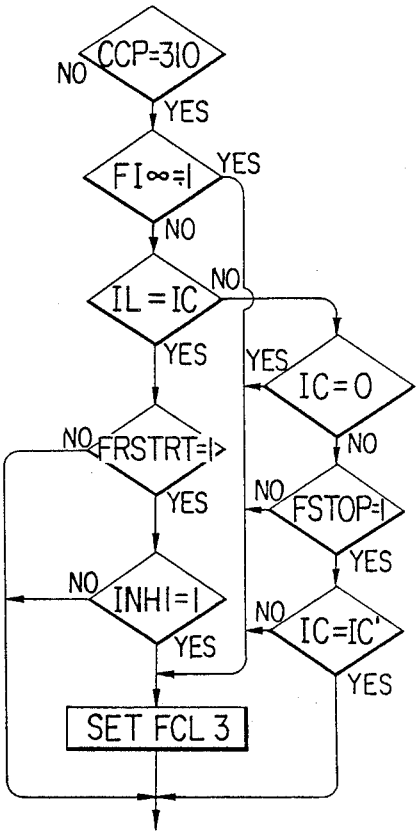
Figure 10D:
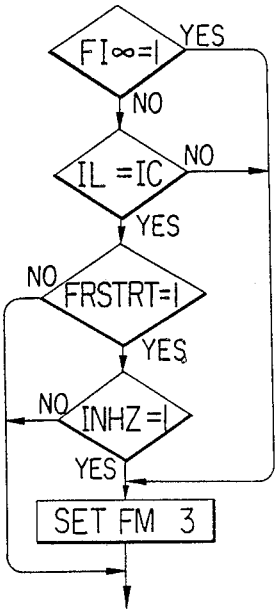
Figure 10E:
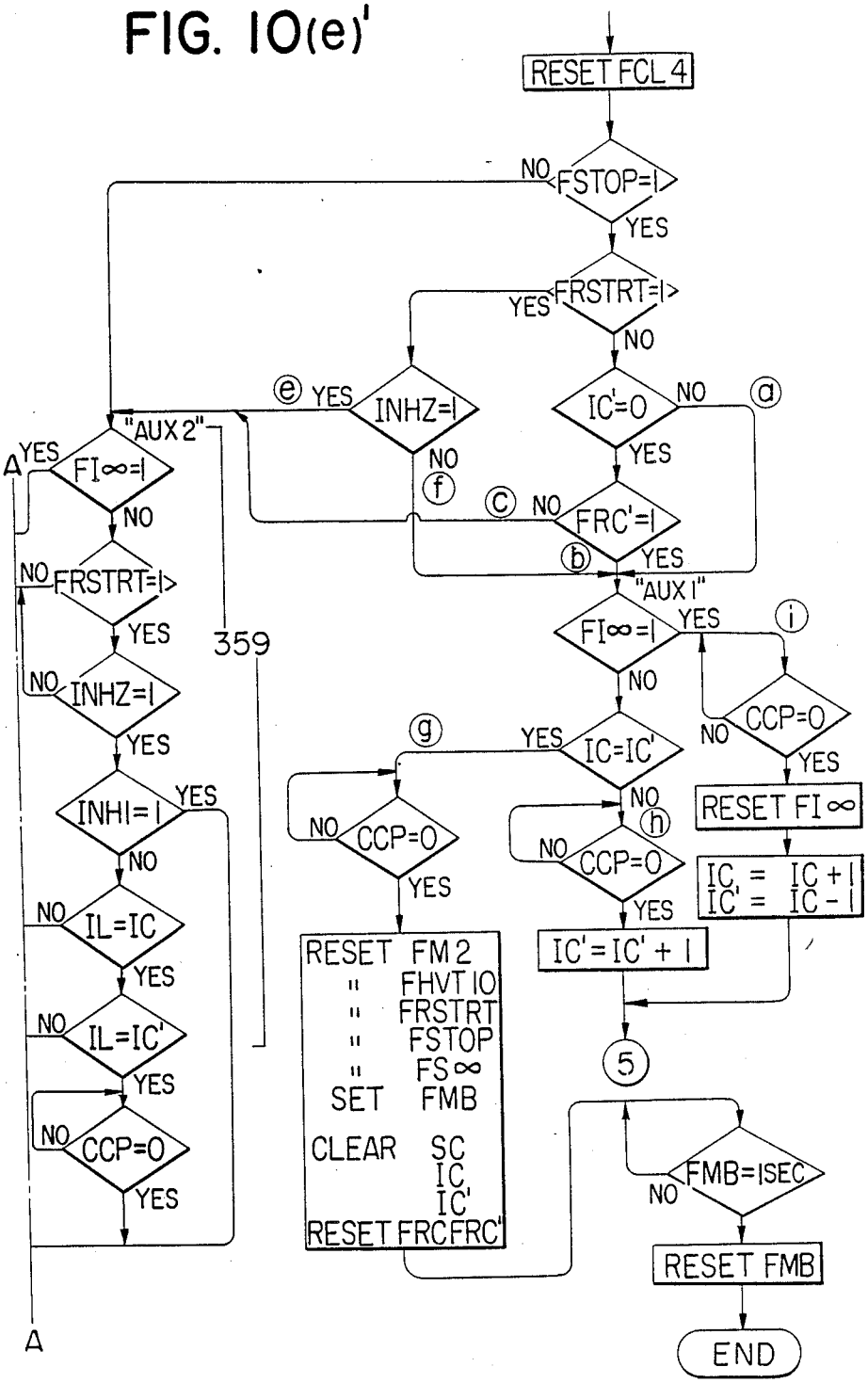
Figure 10E:
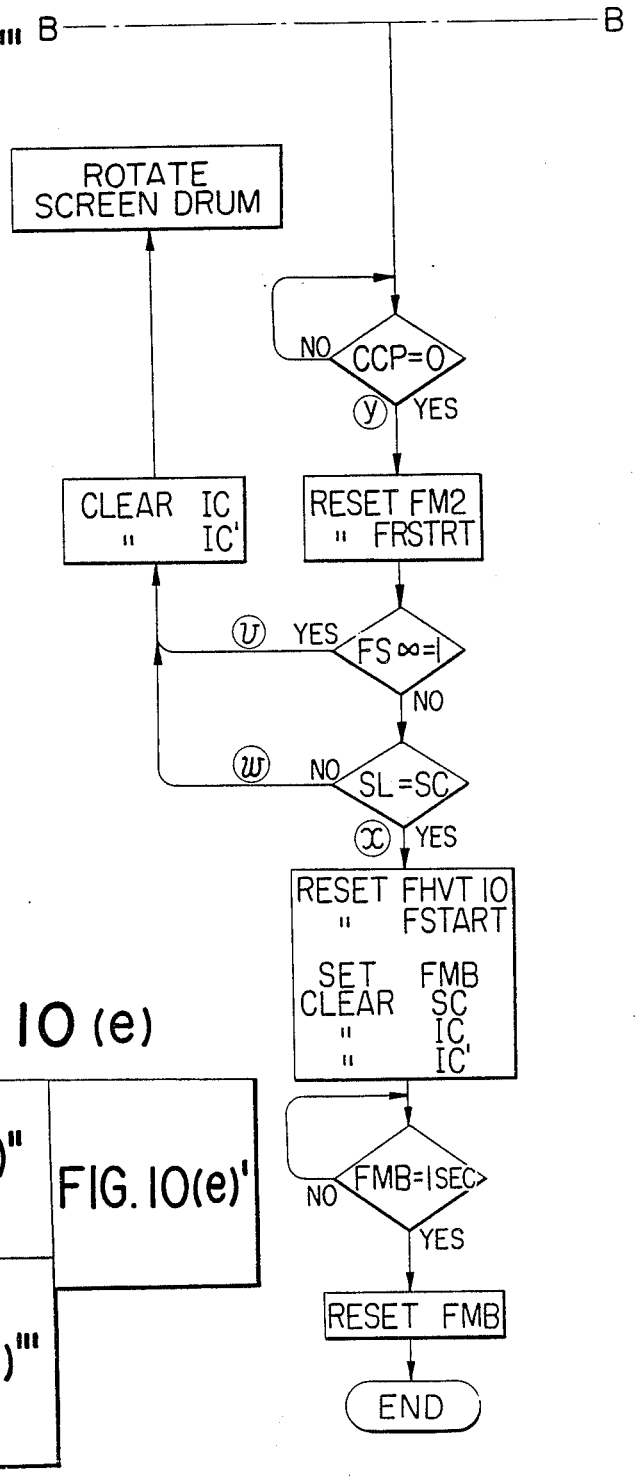
Figure 10:
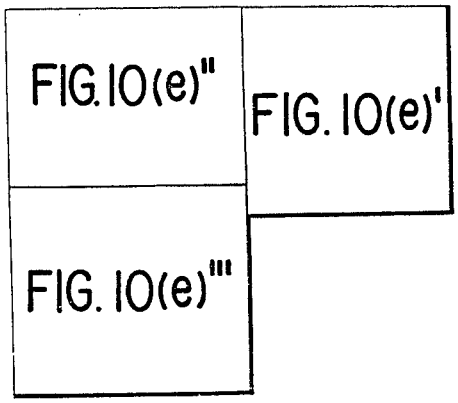
Figure 11:
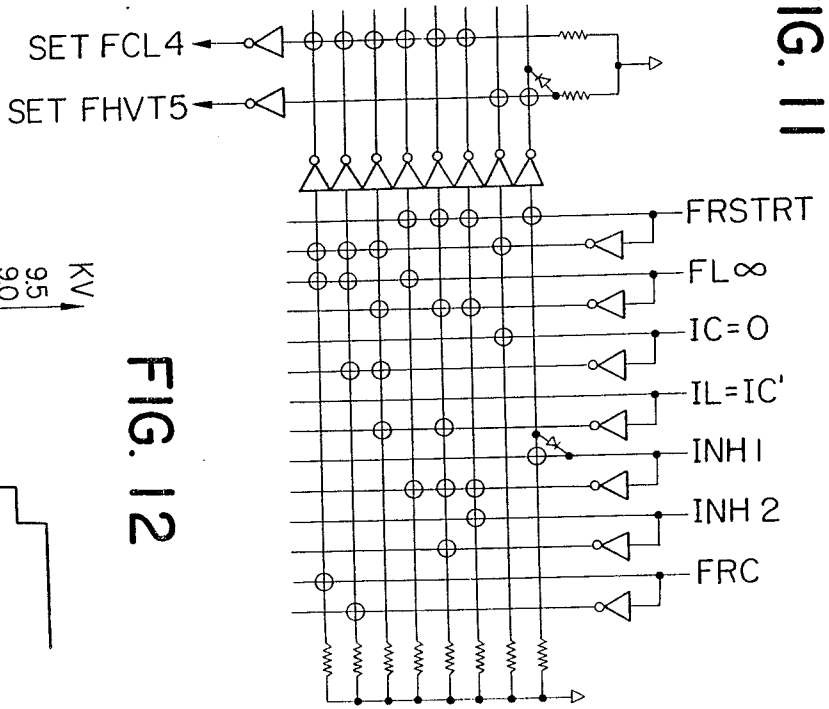
FIG. 11 diagrammatically shows an example of the circuit realizing the sequence judgement of FIG. 10.

The sequence control after the above-described latent image modulation employs a system similar to the flow of judgment in FIG. 5 and the judgment circuit of FIG. 6 already described in connection with the sequence of primary latent image formation. As is apparent from what has already been described, each cycle after the modulation corresponds to one cycle of the 360-counter which counts clock pulses. The pulses 34–35 in FIG. 3 are generated with proper count of each cycle, whereas not all of them are used but they are used only in well-conditioned cycles to turn on or off the flip-flops for latching the associated devices and thus, it is possible to form a flow comprising a loop of 0 to 359 of the 360-counter. The schematic of such flow is shown in FIG. 10, and this flow may be represented by an electric circuit as shown in FIG. 11. In the manner as described above, this flow comprising a programmed series of sequences based on the pulse count may be incorporated in a circuit having a diode matrix comprising two blocks and inverters, thereby enabling the sequence control to be accomplished without using any kind of switches. In FIGS. 10 and 11, Set FHVT5 orders ON of the first modulating charger, Reset FCL3 orders OFF of the paper feed roller, Set FCL4 orders ON of the timing roller, FRSTRT judges whether copying after the modulation should be started or not, and $FI_{\infty}$ judges whether multi-retention or not. In FIG. 10, the blank portions may also put out operational orders for the necessary devices at an appropriate count, as in the flow at count 30. Operating circuits for other devices may also be formed in the manner as shown in FIG. 11.

Figure 12:
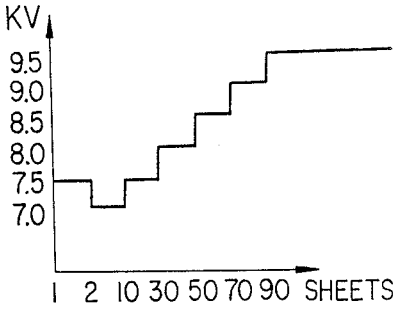
FIGS. 12 and 13 are a graph and a circuit diagram, respectively, illustrating the correction of the variation in image quality taking place during retention copying.

Description will now be made of means for effecting the retention stably. As the number of times of the retention progresses, the electrostatic latent image formed on the screen suffers from natural loss of charges and reduced potential, which affects the gradation, contrast or the like of the resulting visible image. To correct the variation in the image resulting from such reduced potential, the present invention increases the potential of the second modulating charger as the number of times of the retention progresses. In the present apparatus, as is illustrated in FIG. 12, the potential is higher for the first sheet than for the second and subsequent sheets, whereafter the potential is stepwisely increased for the tenth, the thirtieth, the fiftieth, the seventieth and the ninetieth sheet.

Figure 13:
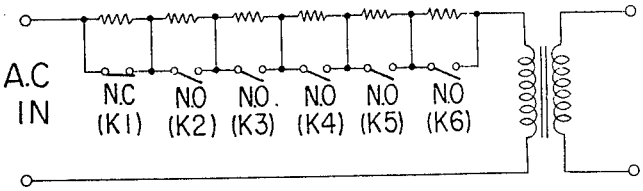

The rise and fall of the potential may be accomplished by varying the input voltage at the primary winding of the high tension transformer. This will more specifically be described with respect to FIG. 13. Six resistors are inserted in series and these resistors are successively short-circuited by relays or the like operable with increase in the number of times of the retention, thereby increasing the potential. These resistors may be inserted in series as shown, or alternatively different resistance values may be parallel-connected and they may be changed over therebetween.

Figure 14:
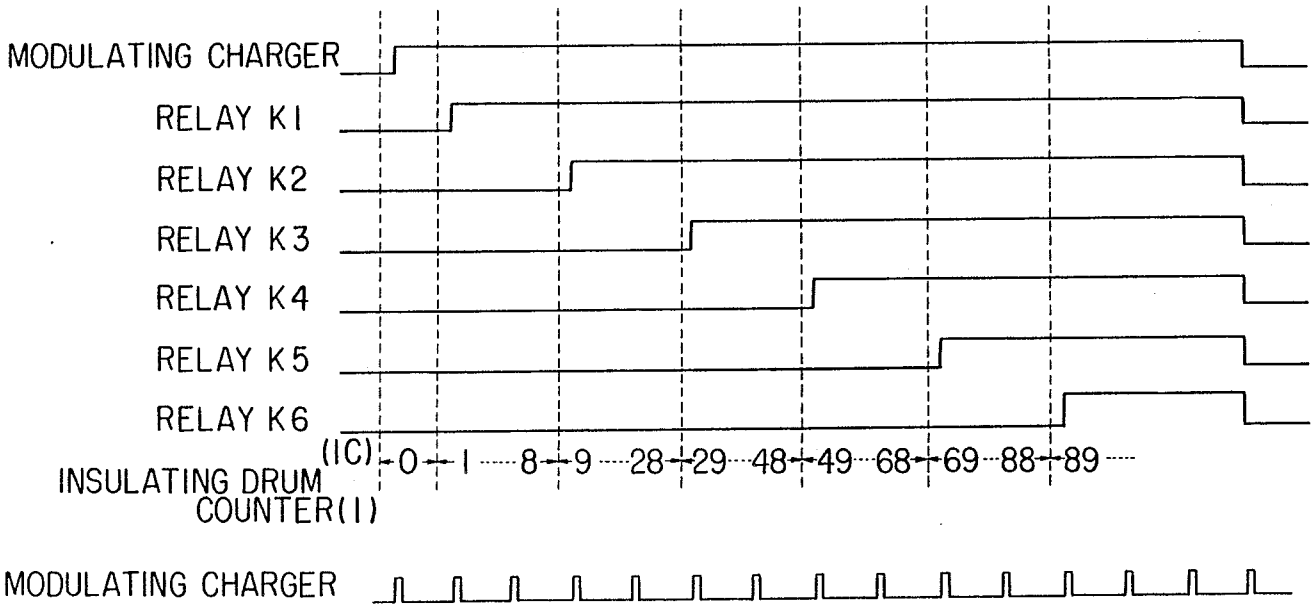
FIG. 14 is a time chart of the operations of the elements in FIG. 13.
Figure 15:
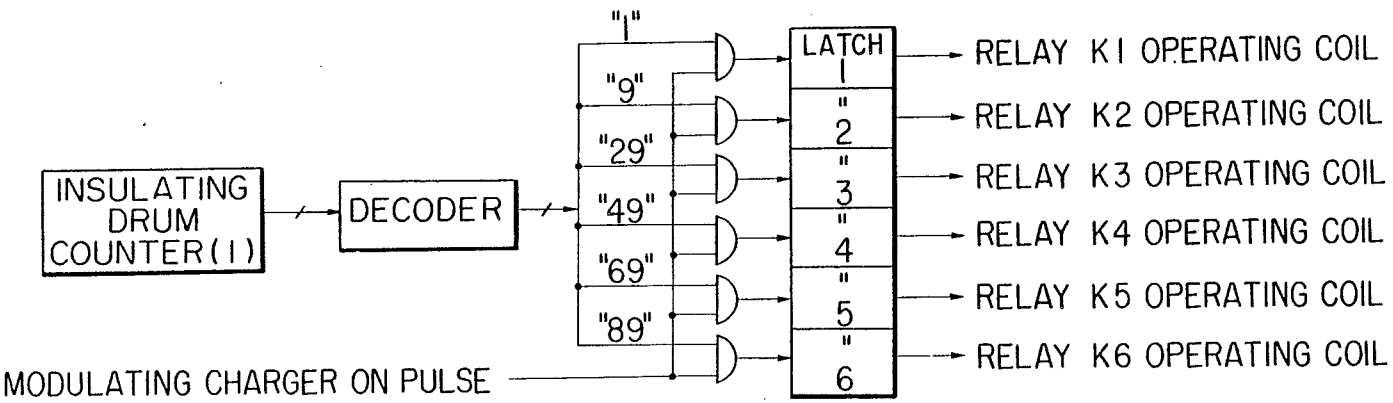
FIG. 15 diagrammatically shows an example of the driving circuit for FIG. 13.

The timing with which the above-mentioned relays or switches are operated is shown in FIG. 14. Such timing may be formed by a combination of the insulating drum counter (1) and the modulating charger ON pulse. For example, in the present apparatus wherein the potential is varied for the second, the tenth, the thirtieth, the fiftieth, the seventieth and the ninetieth sheet, the timing is provided by the modulating charger ON pulse gated by decoded output of the insulating drum counter (1). Accordingly, the operating pulse for relays K1–K6 is put out at count 80 of clock pulse when IC=1 for the second sheet, when IC=9 for the tenth sheet, when IC=29 for the thirtieth sheet, when IC=49 for the fiftieth sheet, when IC=69 for the seventieth sheet, and when IC=89 for the ninetieth sheet, respectively, whereby latches 1–6 are set to operate the coils of the relays K1–K6.

Figure 19:
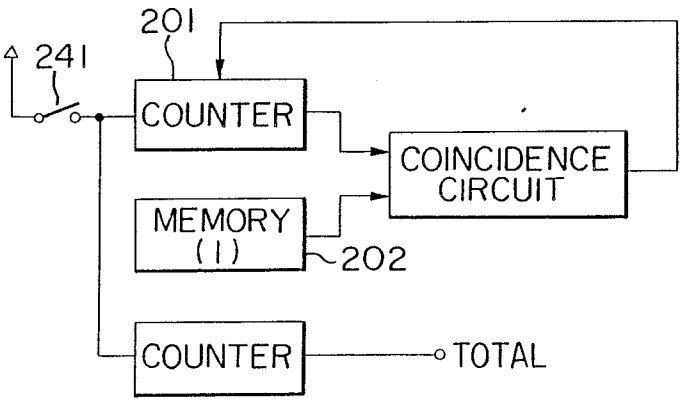
FIG. 19 schematically illustrates the accounting system.

Description will now be made of a rational method of accounting the copying fees in the copying apparatus of the present invention. The light source for illuminating the image original is used only during the step of primary latent image formation and the deterioration of the photosensitive medium is usually induced by the passage of current through the photosensitive medium and thus, the deterioration of the light source and of the photosensitive screen occurs mostly during the step of primary latent image formation and has little or nothing to do with the subsequent steps. Such a copying apparatus, therefore, requires not only a method of accounting the fees by the size and quality of the copying paper used but also a method of accounting the fees by taking into consideration the difference between the step of forming a primary latent image on the photosensitive screen and the subsequent steps up to the step of transferring the image to the copying paper. An example of the latter method will be explained by reference to FIG. 19. In this Figure, there is seen a total counter 191 for counting the number of times the formation of electrostatic latent image on the photosensitive screen occurs, and a total counter 192 for counting the number of times the steps of forming a secondary latent image on the insulating drum from the primary latent image on the screen drum, developing the secondary latent image and transferring the developed image to copying paper occur (which number agrees with the integrated number of copy sheets). The other reference numerals correspond to the reference numerals in FIG. 2 (block diagram of the operating board). Operation will now be explained. Each time an electrostatic latent image is formed on the screen drum by the image original being illuminated, the count-up switch 241 repeats ON and OFF and correspondingly, the numbers in the counter 201 and the total counter 191 are each increased by 1. The apparatus repeats a series of copying operations and, when the number in the counter 201 comes to agree with the preset number of copies stored in the memory 202, the counter 201 is cleared. On the other hand, the total counter 191 is not cleared but still continues to count even for the ensuing copying operations. That is, when the image original copied is removed and replaced by another image original and a new number of copies is set, the counter 201 again begins to count up from 1 to 2, 3 and so on, but the total counter 191 begins to count up from the previous count plus 1. Also, each time the count-up switch 242 for the steps of secondary latent image formation, development and transfer to copy paper repeats ON and OFF, the counter 204 and the total counter 192 perform their respective functions corresponding to those of the counter 201 and the total counter 191, and the total counter 201 is not cleared but continues to count the total number of copies produced. In this manner, the number of times the electrostatic latent image formation occurs on the screen drum and the subsequent steps up to the transfer of visible image to copying paper are individually counted, whereby the counts by the respective total counters are individually totalled at discrete rates at the time of accounting. By so accounting the copying fees, there is provided an accounting system whereby the unit price of copy is gradually decreased with increase in the number of copies in a case where a number of copies are desired from the same image original, and such an accounting system may be said to have made the best use of the features of the present invention.

Also, whenever paper jams in its passageway during copying, the apparatus may be restored to its normal condition if the jamming paper is removed by the operator and thus, removal of jam may be readily done by the operator if he is only informed of where in the apparatus the jam has occured. In the present embodiment, a display device for displaying the number of copies is used also for that purpose and this display device is a numerical display device which effects two-digit display by the use of seven segments. When paper jams at a second point of detection among numerous possible points of jam detection, the jam will be displayed as J2, as shown in FIG. 22(*a*).

Also, in preparation for a failure occuring to any of the control circuits for the optical system, the developing device, the image transfer, etc. which are necessary to the copying apparatus, numbers corresponding to the respective control circuits may be predetermined so that, when for example, the control circuit for the optical system (corresponding number is No. 8) fails, F8 may be displayed by taking the initial of "Failure", as shown in FIG. 22(*b*). At sight of this, the user may know the presence of a failure in the apparatus and may also report the failure number to the service department of the manufacturer so that a serviceman can quickly take proper measures. This will lead to a shorter time required for the service.

The same display device may also be used to indicate the presence or absence of copy paper. More specifically, the absence of paper may be displayed as PE which comprises the initials of "Papers End" and if the apparatus is equipped with a number of cassettes for containing copy paper, the number of the cassette which has become empty may be additionally indicated after PE, for example, like PE3 as shown in FIG. 22(*c*), which means that cassette No. 3 has become empty. This may also be displayed by two digits, as P3.

Further, exhaustion of the developer used for the image development may be displayed as DE (FIG. 22(*d*)), and exhaustion of Isopar may be displayed as IE (FIG. 22(*e*)). The initial letters used to represent the various states are not restricted to the shown examples.

Figure 23:
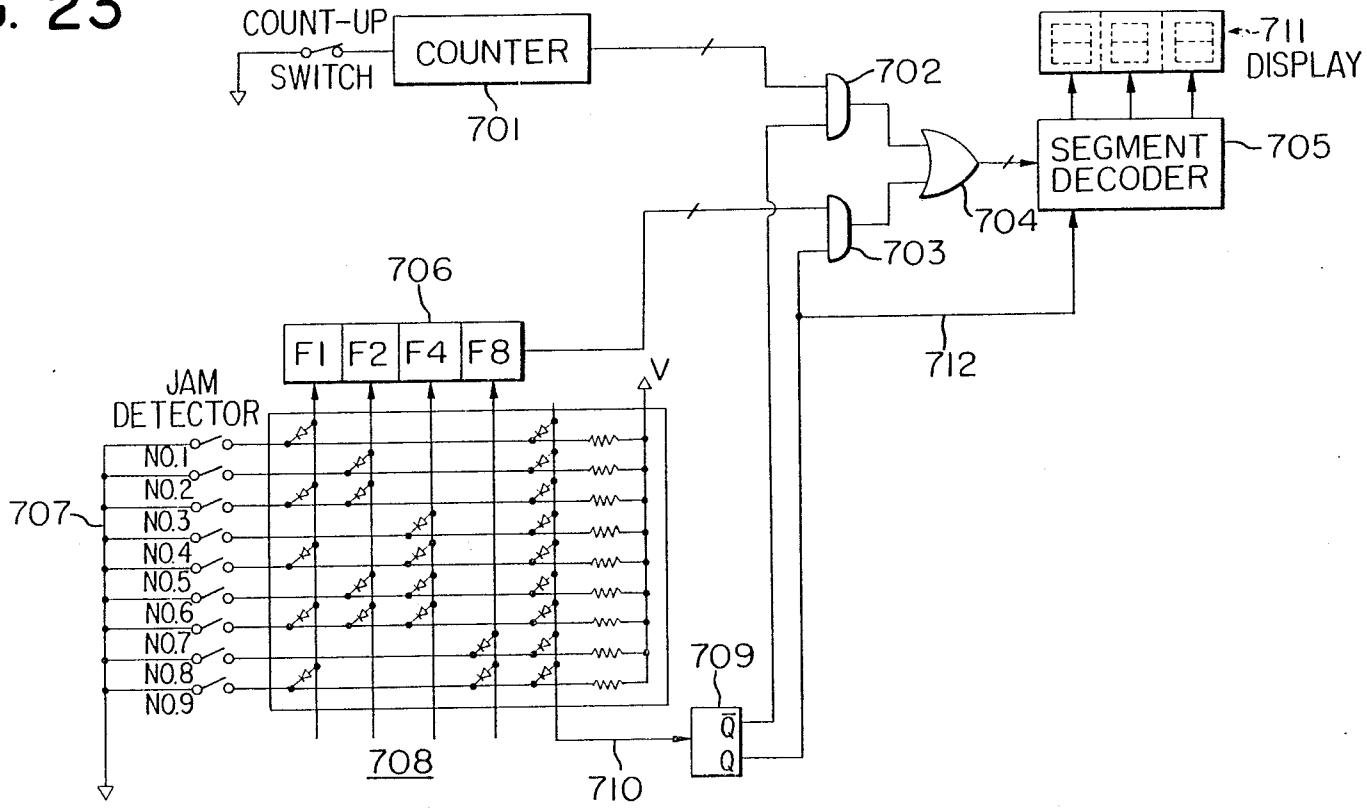
FIG. 23 shows an example of the driving circuit for effecting the displays shown in FIG. 22.

Reference will now be had to FIG. 23 to describe a circuit serving as the change-over means for effecting the above-described displays. In FIG. 23, the counter for displaying the counted number of the copies is diverted to display the jam (as "J", for example) and display the jammed point by figures (as "1" or "2", for example). Thus, a single display device can simply serve both the display of count and the display of jam.

In FIG. 23, there is seen counter means 701 for counting the number of copies produced, a gate 702 for controlling the count output thereof, a gate 703 for output-controlling a jammed point, a gate 704 for putting out a count signal or a jam signal, a decoder 705 for converting the output of the gate 704 into transmission signals for the segments of a display device 711, flip-flops 706 for putting out a binary signal indicative of the jammed point, a detector 707 for detecting the jammed point, an encoder 708 for converting the detection signal into a binary coded decimal output, and a flip-flop 709 for putting out a jam signal.

More than one jam detectors 707 (substantially represented by switches) are pre-numbered (for example, 01 for the neighborhood of the timing roller, 02 for the neighborhood of the paper separator, 03 for the neighborhood of the fixing device, . . . ), and any of these numbers is converted into a binary number by the encoder 708, the output of which is in turn applied to a group of more than one flip-flops corresponding to the weight of the binary number. The encoder 708 also puts out a jam detection signal 710 to set the flip-flop 709, the output of which is used to change over the counter 701 to the jam display. By this change-over, the contents of the counter 701 are passed through the gate 702 and the binary coded output of the flip-flops 706 is passed through the gate 703, and binary-decimalized by the decoder 705 and displayed by the display device.

Description will be made of, for example, a case where jam detector No. 2 is operated to display "J02" on the three-digit display device.

When jam detector No. 2 is operated, the flip-flop F2 of weight 2 and the flip-flop 709 are set by the encoder 708 and the counter 701 is stopped from counting, whereupon the gate 2 is closed and the gate 703 is opened. The contents of the flip-flop group 706 are passed through the gate 703 and through the gate 704 to the decoder 705, whereby they are displayed in the two least significant digit places of the display device. The output of the flip-flop 709 is directly applied to the decoder 705 and coded into character "J", which is in turn displayed in the most significant digit places of the display device.

While the present invention has been described with respect to a copying apparatus in which visible image is transferred to plain paper, the invention will be very effectively applicable to an apparatus utilizing the so-called TESI system in which a latent image formed on a photosensitive medium by exposure and other steps is directly transferred to plain paper to thereby produce a copy or an apparatus in which a secondary latent image on an insulating drum is directly transferred to plain paper and the transfer image is developed to produce a copy. The invention will also be effective for ordinary copying machines in which a set number of copies are produced.

What we claim is:

1. An image forming apparatus, comprising:

setting means for setting numerical data related to image formation;

memory means for storing the numerical data set by said setting means;

generating means for generating a start signal that instructs a start of an image formation operation;

detecting means for detecting an improper operational state of said image forming apparatus;

executing means for executing, in response to the start signal, the image formation operation in accordance with the numerical data stored in said memory means, and for interrupting the image formation operation when said detecting means detects the improper operational state; and inhibiting means for inhibiting numerical data from being set by said setting means in response to the start signal, and for inhibiting numerical data from being set by said setting means during the improper operational state of said image forming apparatus.

2. An apparatus according to claim 1, wherein said setting means sets numerical data representing the desired number of image formations.

3. An apparatus according to claim 1, wherein said memory means retains the numerical data originally set by said setting means during the improper operational state of the apparatus.

4. An apparatus according to claim 1, wherein said improper operational state of the image forming apparatus comprises a jamming of a material to be subjected to the image formation.

5. An apparatus according to claim 1, further comprising means for displaying the numerical data related to the image formation operation.

6. An apparatus according to claim 5, wherein said displaying means displays a content of the improper operational state of the image forming apparatus during said improper operational state.

7. An apparatus according to claim 1, wherein said executing means comprises means for forming an image on a material.

8. An apparatus according to claim 7, further comprising forming means for exposing an original image, wherein said forming means forms the image corresponding to the original image exposed by said exposing means.

9. An image forming apparatus, comprising:

setting means for setting numerical data related to image formation;

memory means for storing the numerical data set by said setting means;

cancelling means for cancelling the numerical data stored in said memory means;

generating means for generating a start signal that instructs a start of an image formation operation;

detecting means for detecting an improper operational state of said apparatus;

executing means for executing, in response to the start signal, the image formation operation in accordance with the numerical data stored in said memory means, and for interrupting the image formation operation when said detecting means detects the improper state; and inhibiting means for inhibiting numerical data from being cancelled by said cancelling means in response to the start signal, and for inhibiting numerical data from being cancelled by said cancelling means during an improper operational state of said image forming apparatus.

10. An apparatus according to claim 9, wherein said setting means sets numerical data representing the desired number of image formations.

11. An apparatus according to claim 9, wherein said memory means retains the numerical data originally set by said setting means during the improper operational state of the image forming apparatus.

12. An apparatus according to claim 9, wherein said improper operational state of the image forming apparatus comprises a jamming of a material to be subjected to the image formation.

13. An apparatus according to claim 9, further comprising means for displaying the numerical data related to the image formation.

14. An apparatus according to claim 13, wherein said displaying means displays a content of the improper operational state of the image forming apparatus during said improper operational state.

15. An apparatus according to claim 9, wherein said executing means comprises means for forming an image on a material.

16. An apparatus according to claim 15, further comprising exposing means for exposing an original image, wherein said forming means forms the image corresponding to the original image exposed by said exposing means.

17. An image forming apparatus, comprising:

setting means for setting numerical data related to image formation;

memory means for storing the numerical data set by said setting means;

displaying means for displaying the numerical data related to image formation during an image formation operation;

a plurality of detecting means for detecting any one of a plurality of improper operational states of said image forming apparatus;

executing means for executing the image formation operation in accordance with the numerical data stored in said memory means, and for interrupting the image formation operation when any one of said plurality of detecting means detects an improper operational state;

outputting means for outputting data identifying content of the improper operational state detected by said plurality of detecting means;

display controlling means for displaying an identification of the improper operational state on said display means in accordance with the data outputted from said outputting means during the improper operational state of said image forming apparatus; and inhibiting means for inhibiting numerical data from being set by said setting means during any one of said plurality of improper operational states.

18. An apparatus according to claim 17, wherein said setting means sets numerical data representing the desired number of image formations.

19. An apparatus according to claim 17, wherein said memory means retains the numerical data originally set by said setting means during an improper operational state of the image forming apparatus.

20. An apparatus according to claim 17, wherein said improper operational state of the image forming apparatus comprises a jamming of a material to be subjected to the image formation.

21. An apparatus according to claim 17, wherein said display means displays the number of the image formations executed during an image formation operation.

22. An apparatus according to claim 17, further comprising means for cancelling the numerical data stored in said memory means.

23. An apparatus according to claim 17, wherein said display means is adapted to display the identity of the improper operational state by means of a combination of alpha-numeric characters.

24. An apparatus according to claim 17, wherein said executing means comprises means for forming an image on a material.

25. An apparatus according to claim 24, further comprising exposing means for exposing an original image, wherein said forming means forms an image corresponding to the original image exposed by said exposing means.

* * * * *

UNITED STATES PATENT AND TRADEMARK OFFICE

CERTIFICATE OF CORRECTION

PATENT NO. : 4,937,621

DATED : June 26, 1990

INVENTOR(S) : KATSUICHI SHIMIZU ET AL.

It is certified that error appears in the above-identified patent and that said Letters Patent is hereby corrected as shown below:

ON THE TITLE PAGE,
AT [56] REFERENCES CITED

U.S. Patent Documents, "3,558,472 6/1971 Glaster et al." should read --3,588,472 6/1971 Glaster et al.--.

COLUMN 2

Line 25, "temporally" should read --temporarily--.

COLUMN 3

Line 7, "numberical" should read --numerical--.

COLUMN 5

Line 33, "divider" should read --divided--.
Line 64, "by" (first occurrence) should read --be--.

COLUMN 6

Line 32, "conveyer belt 39" should read --conveyer belt 38--.
Line 35, "belt 39" should read --belt 38--.
Line 39, "rollers 43 and 45" should read --rollers 43 and 44--.

COLUMN 7

Line 32, "why" should be deleted.
Line 33, "why" should be deleted.
Line 61, "and and" should read --and an--.

UNITED STATES PATENT AND TRADEMARK OFFICE

CERTIFICATE OF CORRECTION

PATENT NO. : 4,937,621

DATED : June 26, 1990

INVENTOR(S) : KATSUICHI SHIMIZU ET AL.

It is certified that error appears in the above-identified patent and that said Letters Patent is hereby corrected as shown below:

COLUMN 8

Line 48, ""and" should read --and--.

COLUMN 10

Line 61, "temporally" should read --temporarily--.

COLUMN 13

Line 10, "number counter" should read --number counted--.
Line 44, "FIGS." should read --Figure,--.

COLUMN 15

Line 13, "insulating drum counter IC8" should read --insulating drum counter IC'--.

Signed and Sealed this

Nineteenth Day of May, 1992

*Attest:*

DOUGLAS B. COMER

*Attesting Officer*

*Acting Commissioner of Patents and Trademarks*